US006871949B2

(12) United States Patent
Nakano et al.

(10) Patent No.: US 6,871,949 B2
(45) Date of Patent: Mar. 29, 2005

(54) RECORDING APPARATUS

(75) Inventors: Yuji Nakano, Kanagawa-ken (JP); Toshiya Matsumoto, Kanagawa-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/639,511

(22) Filed: Aug. 13, 2003

(65) Prior Publication Data

US 2004/0036756 A1 Feb. 26, 2004

(30) Foreign Application Priority Data

Aug. 21, 2002 (JP) ..... 2002-240239

(51) Int. Cl.[7] ..... B41J 2/01

(52) U.S. Cl. ..... 347/104; 347/153; 400/605; 400/608.2

(58) Field of Search ..... 400/605, 607, 400/607.2, 608.2, 608.4, 48; 347/107, 104, 103, 157; 101/44

(56) References Cited

U.S. PATENT DOCUMENTS

| | | | | | |
|---|---|---|---|---|---|
| 5,149,217 | A | * | 9/1992 | Narita | 400/608.4 |
| 5,923,404 | A | * | 7/1999 | Yoshida | 355/27 |
| 6,201,596 | B1 | * | 3/2001 | Sugita | 355/41 |
| 6,360,657 | B1 | * | 3/2002 | Tanabe et al. | 101/44 |
| 6,447,113 | B1 | * | 9/2002 | Silverbrook et al. | 347/103 |
| 6,527,360 | B2 | * | 3/2003 | Otsuki et al. | 347/19 |
| 6,709,175 | B1 | * | 3/2004 | Drynkin et al. | 400/48 |
| 6,782,822 | B2 | * | 8/2004 | Verhoest et al. | 101/424.1 |

* cited by examiner

*Primary Examiner*—Eugene H. Eickholt
(74) *Attorney, Agent, or Firm*—Fitzpatrick, Cella, Harper & Scinto

(57) ABSTRACT

The present invention relates to a recording apparatus for recording with a recording section including a feeding section for separately feeding recording paper sheet by sheet and a conveyance route extending substantially straight for conveying a recording medium having a high rigidity. A part of the feeding section is overlapped with the conveyance route in a vertical cross-sectional direction, but is not overlapped in a direction intersecting with the conveyance direction of the recording medium.

18 Claims, 22 Drawing Sheets

(Before CD conveyance member is attached)

(After CD conveyance member is attached)

(Status before CD conveyance member is attached)

(Status when slide cover is moved after conveyance member attached)

(Before slide cover is moved)

(After slide cover is moved)

(Status when carriage descends)

(Status when carriage rises)

RECORDING APPARATUS

BACKGROUND OF THE INVENTION

1. Field of the Invention

This invention relates to a recording apparatus such as a printer in which one recording portion is commonly used for a recording medium having a low rigidity such as a paper and for a recording medium having a high rigidity such as a CD.

2. Description of Related Art

Various recording media recorded with recording apparatuses such as printers or the like have been proposed conventionally. There are compact thick recording media, such as CDs, DVDs, and cards (hereinafter referred collectively to as "CD" or "compact disc"). In a printer currently used widely, if a conveyance route for a single sheet is used when recording is made on the above recording medium, there arise problems, such as the rigidity makes the conveyance property worse, physical damage may occur, and conveyance is impossible due to the relation of distances between conveyance rollers. A tray for mounting a thick recording medium such as a CD is therefore used, and a single recording section is commonly used and made operable where a route different from the conveyance route for a single sheet is used.

Because a common single sheet used in a widely used printer has a low rigidity, there arises a problem regarding floating at the recording section. The recording medium having a relatively low rigidity such as a single sheet enters with an angle of 10 to 15 degrees with respect to the lower surface (hereinafter referred to as "platen") of the recording portion, and is prevented from floating at the recording section upon being pushed to the platen. The nipping state of the conveyance roller for conveying the recording medium toward the recording section is therefore slanted. Generally, feeding rollers of a feeding section located on an upstream side in the conveyance direction of the conveyance roller are arranged in a vertical direction with respect to nipping portion of the conveyance roller in order to render effective introduction of the recording medium into the nipping portion of the conveyance rollers. This is because, where the conveyance route from the feeding rollers to the conveyance rollers is bent, a load may be produced at the recording medium during recording, detection accuracy of the front end position of the recording medium may be lowered, and paper jamming may easily occur. Therefore, where the conveyance route from the feeding rollers to the conveyance rollers is made substantially straight, the feeding rollers and a separation section of the feeding section are located obliquely above the conveyance rollers.

When recording is made on a recording medium having a relatively high rigidity such as a CD, a straightly extending conveyance route (hereinafter referred to as "conveyance route for rigid body") is needed for conveying a tray mounting the CD as described above.

From this structure, it is necessary to arrange the structure so that the conveyance route for the rigid body and the feeding rollers as well as the separation portion do not interfere with each other at a rear portion or on an upstream side in the conveyance direction of the recording section. Therefore, in a conventional apparatus in which the single recording section is commonly used as described above, both of the above members are arranged as to escape from each other in the cross-sectional direction. For example, the apparatus is designed with some structure such that, e.g., (i) the feeding section is moved to a rear upward location, or upward on the upstream side in the conveyance direction, (ii) a method is adapted using a separation pad having a smaller projection on a lower side of the separation portion (on a conveyance route for rigid body) in comparison with the separation roller, or (iii) the entire feeding section is moved upward.

With the above structures, however, there arise problems such that, e.g., (i) the installation area of the apparatus becomes larger, paper jamming easily occurs due to the longer conveyance route for the recording medium, a recording medium having a short length in the conveyance direction may not be conveyed, and the time needed for recording the recording medium of one piece or sheet may become longer, (ii) the separation property may be worse, and (iii) the apparatus height may become higher and the recording medium may not easily be loaded into the nipping portion of the conveyance rollers.

SUMMARY OF THE INVENTION

It is an object of the invention to provide a recording apparatus capable of recording, while commonly using a single recording section, recording media having low rigidity such as paper and recording media having high rigidity such as CDs, with simple structure and control, lower costs, as well as a compact structure without any inferior performance.

This invention has a feature, in a recording apparatus for recording with a recording means, of a feeding section for separately feeding recording paper sheet by sheet; and a conveyance route extending substantially straight for conveying a recording medium having a high rigidity, wherein a part of the feeding section is overlapped with the conveyance route in a vertical cross-sectional direction but is not overlapped in a direction intersecting to the conveyance direction of the recording medium.

According to this invention, in the recording apparatus commonly using one recording section for recording the recording medium having the low rigidity separately fed from the feeding section and for recording the recording medium having the high rigidity fed from a route different from the route for the recording medium having the low rigidity, the conveyance route for the rigid body serving as the conveyance route for the recording medium having the high rigidity is extending substantially straight, and the part of the feeding section is overlapped with the conveyance route for the rigid body in a vertical cross-sectional direction, but is not overlapped in a direction intersecting the conveyance direction of the recording medium, so that the recording apparatus can be provided with a low cost as well as compact structure and without inferior performance.

DETAILED DESCRIPTION OF THE PREFERRED EMBODIMENTS

Figure 1:
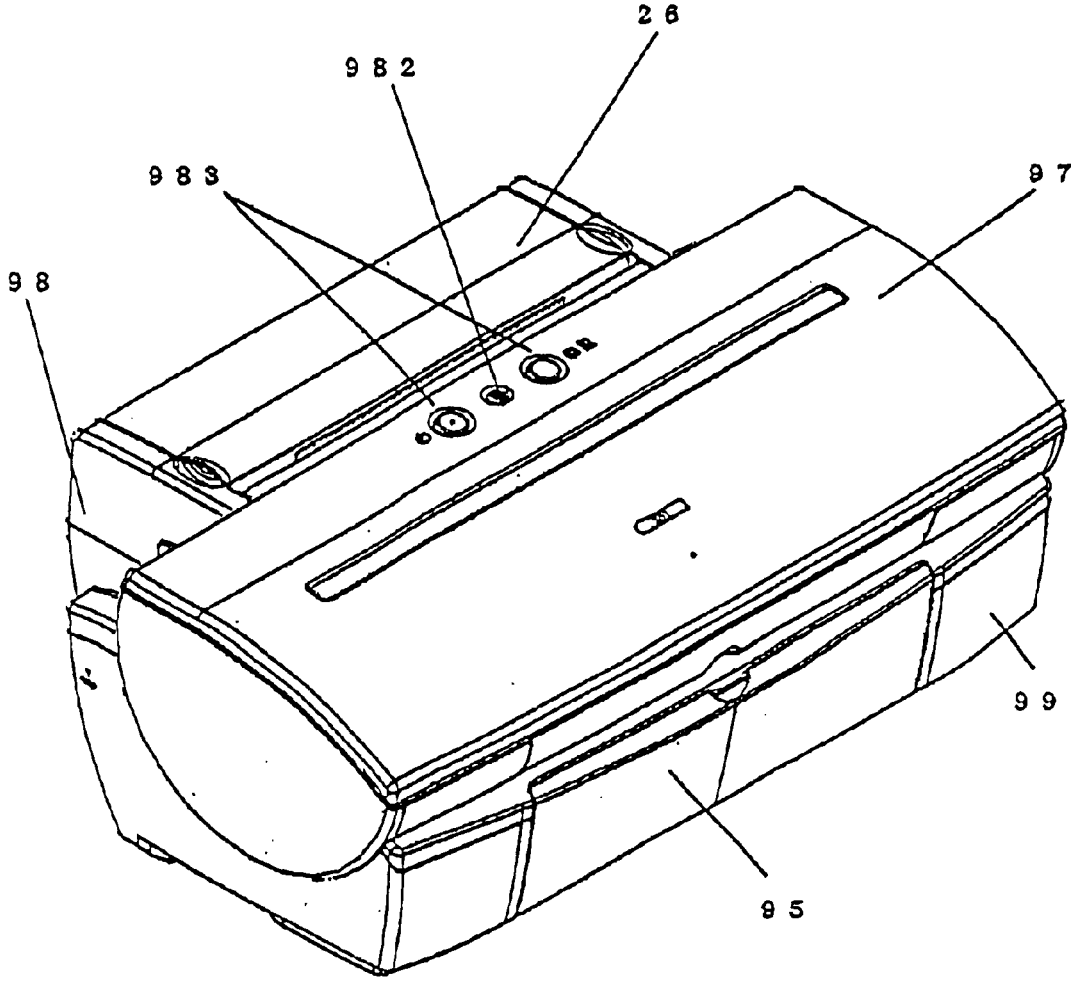
FIG. 1 is a perspective view showing a recording apparatus according to a first embodiment of the invention.

Hereinafter, referring to the drawings, preferred embodiments of the invention are exemplified in detail. Size, material, shape, and relative layout of the structural parts as set forth in the following embodiments can be modified properly according to the structure of the apparatus to which this invention can be applied and various conditions, and where no specific description is provided, the scope of the invention is not limited.

[First Embodiment]

Figure 2:
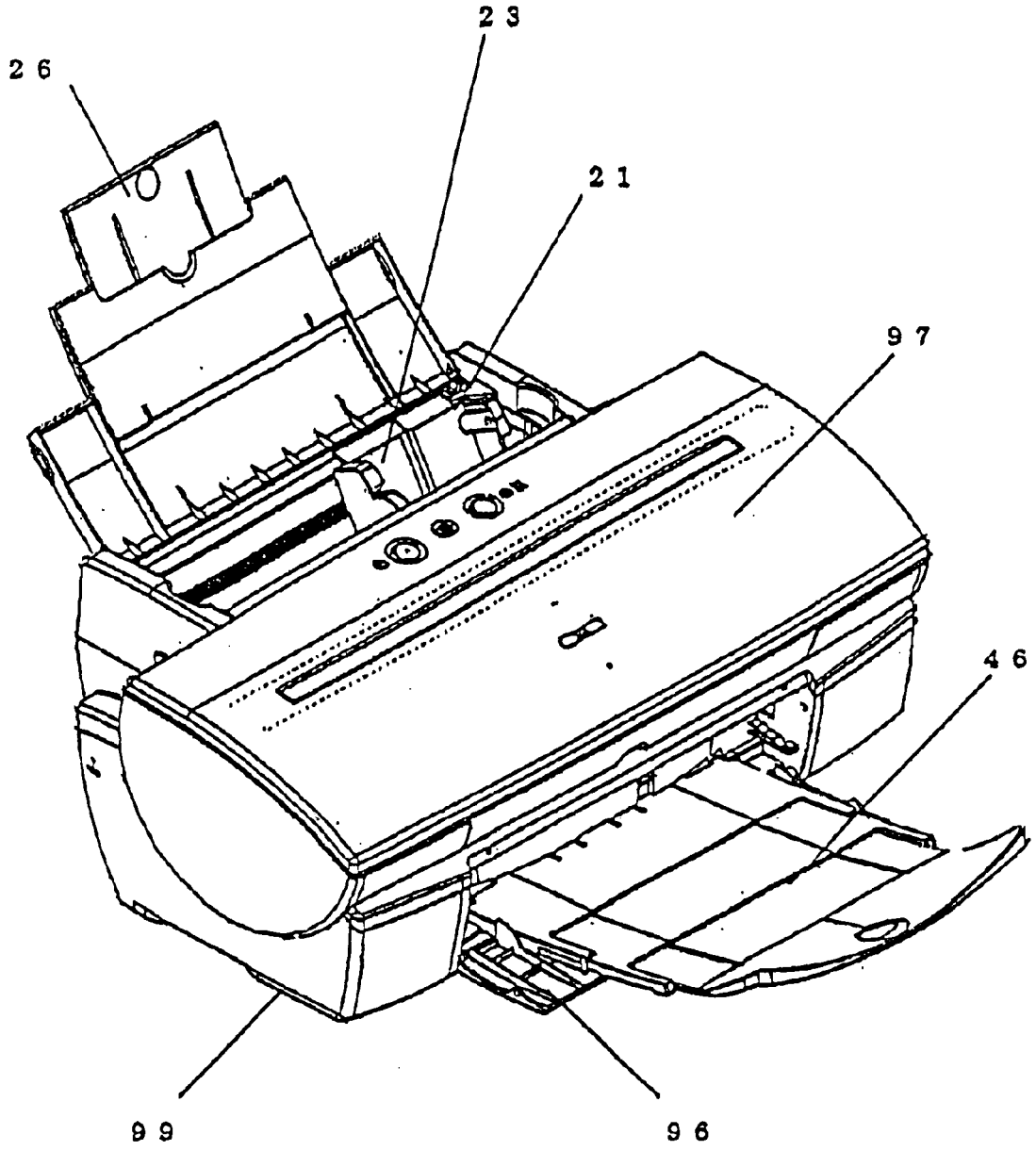
FIG. 2 is a perspective view showing the recording apparatus according to the first embodiment.
Figure 3:
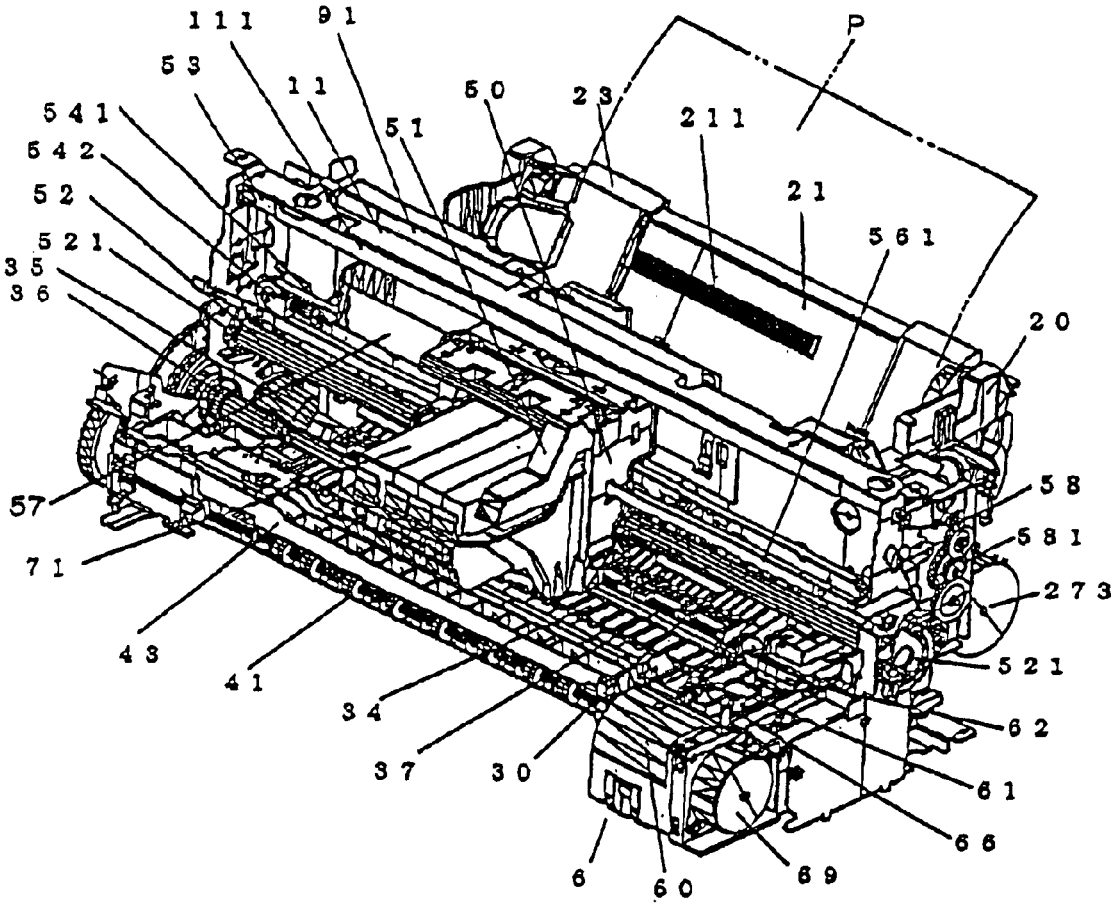
FIG. 3 is a perspective view showing a mechanism section of the recording apparatus according to the first embodiment.
Figure 4:
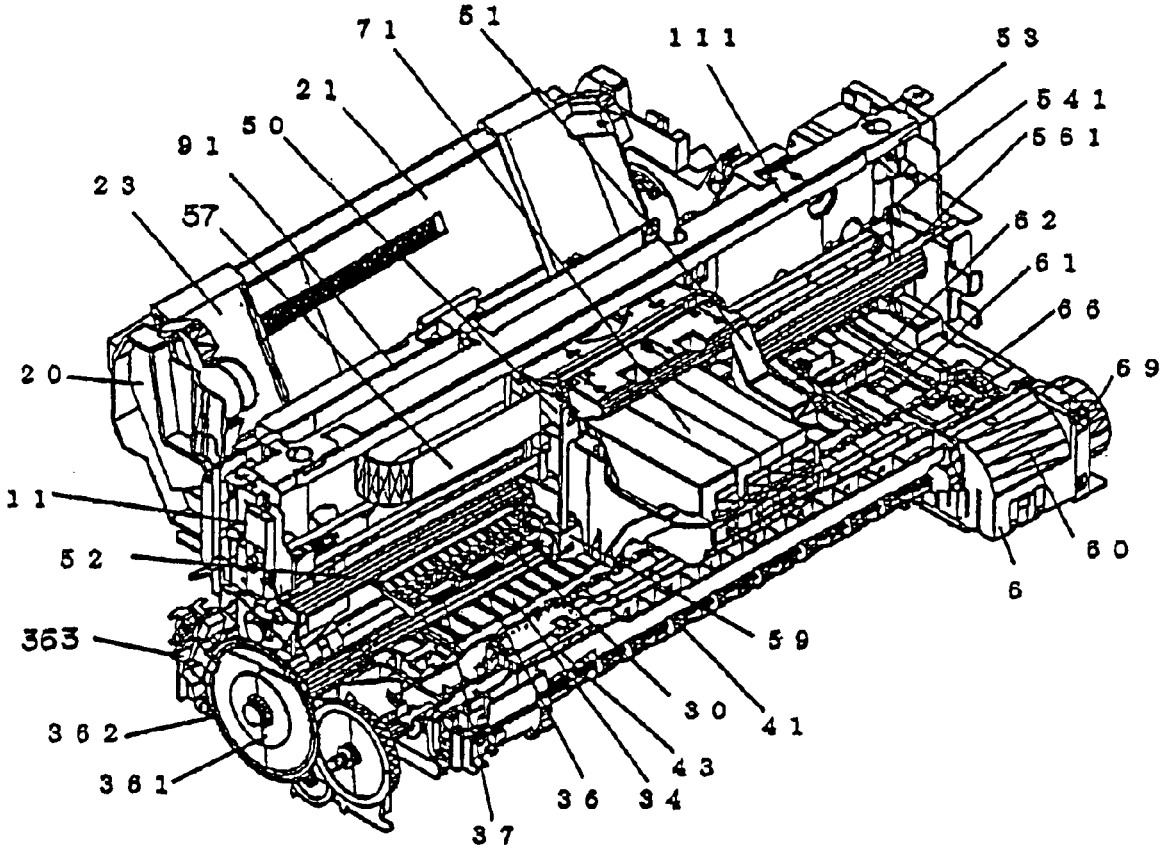
FIG. 4 is a perspective view showing a mechanism section of the recording apparatus according to the first embodiment.
Figure 5:
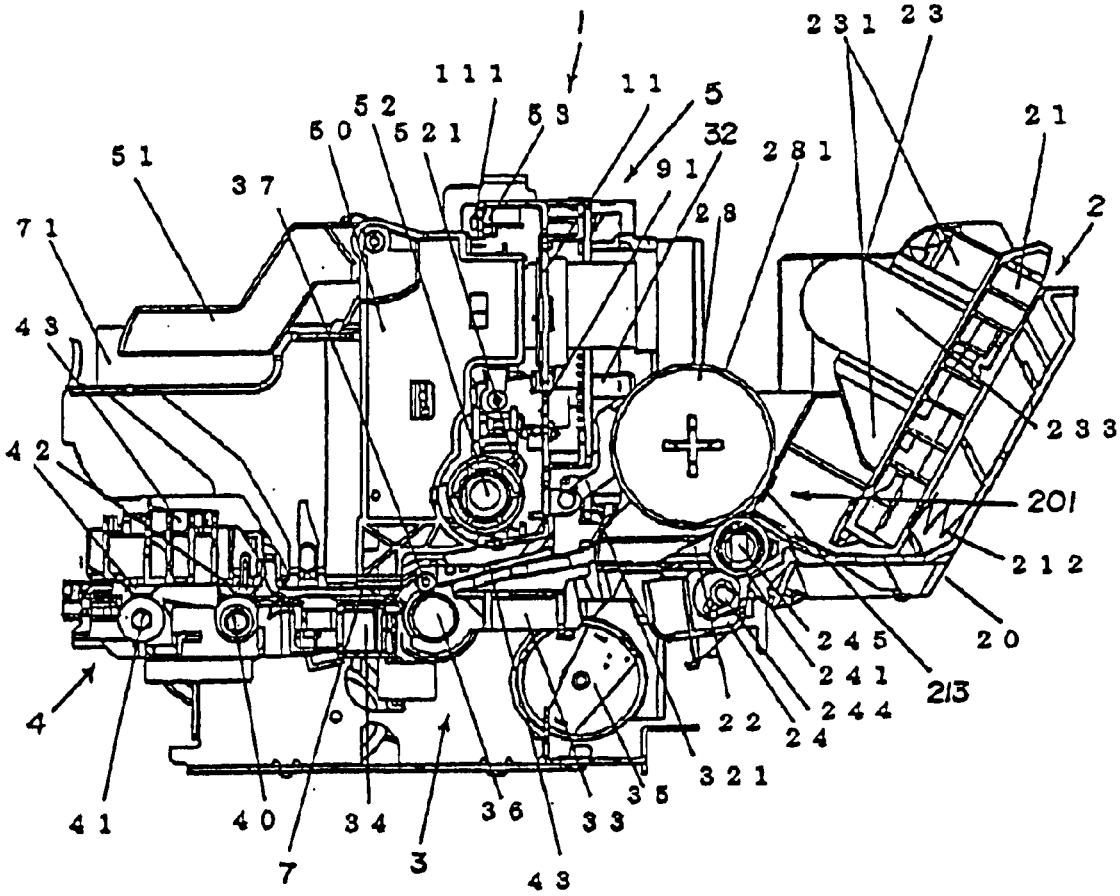
FIG. 5 is a cross-section showing the recording apparatus according to the first embodiment.
Figure 17:
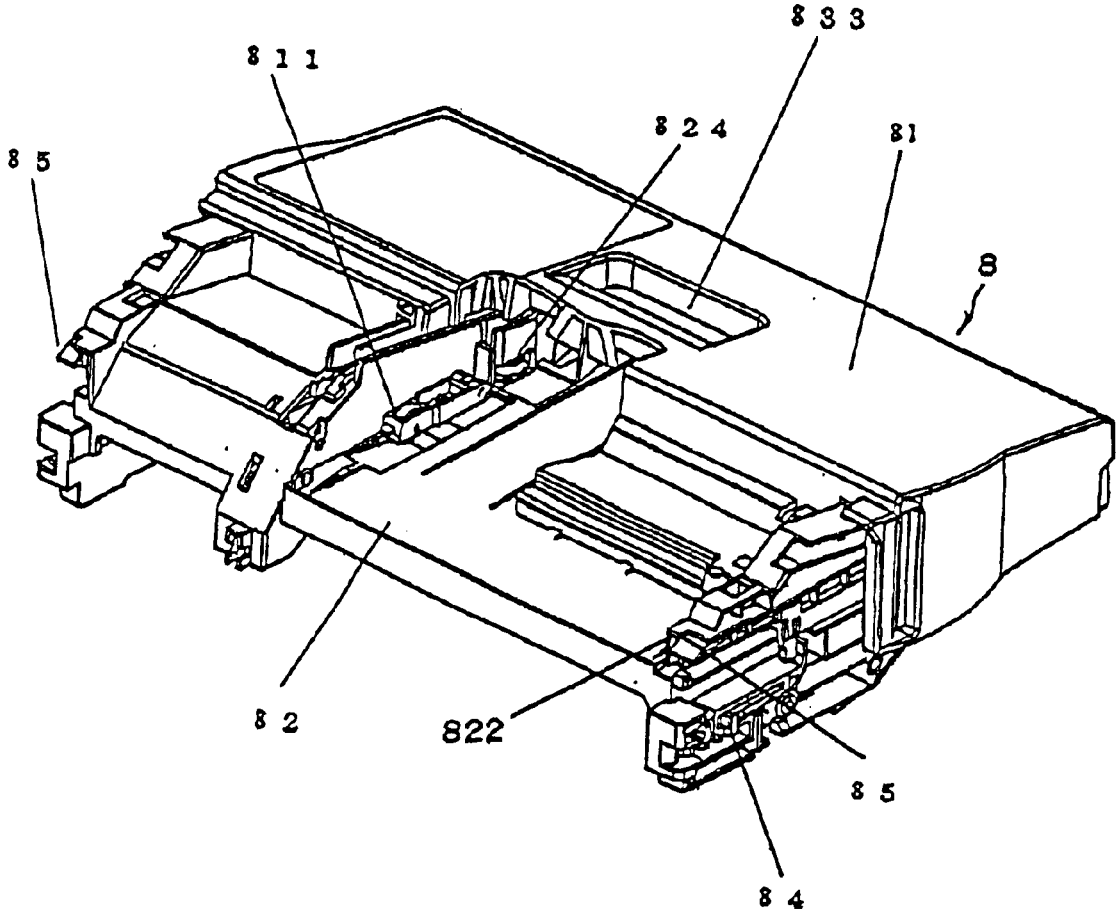
FIG. 17 is a diagram showing exertion to the tray of a side pressing roller and a pushing roller according to the first embodiment.
Figure 18:
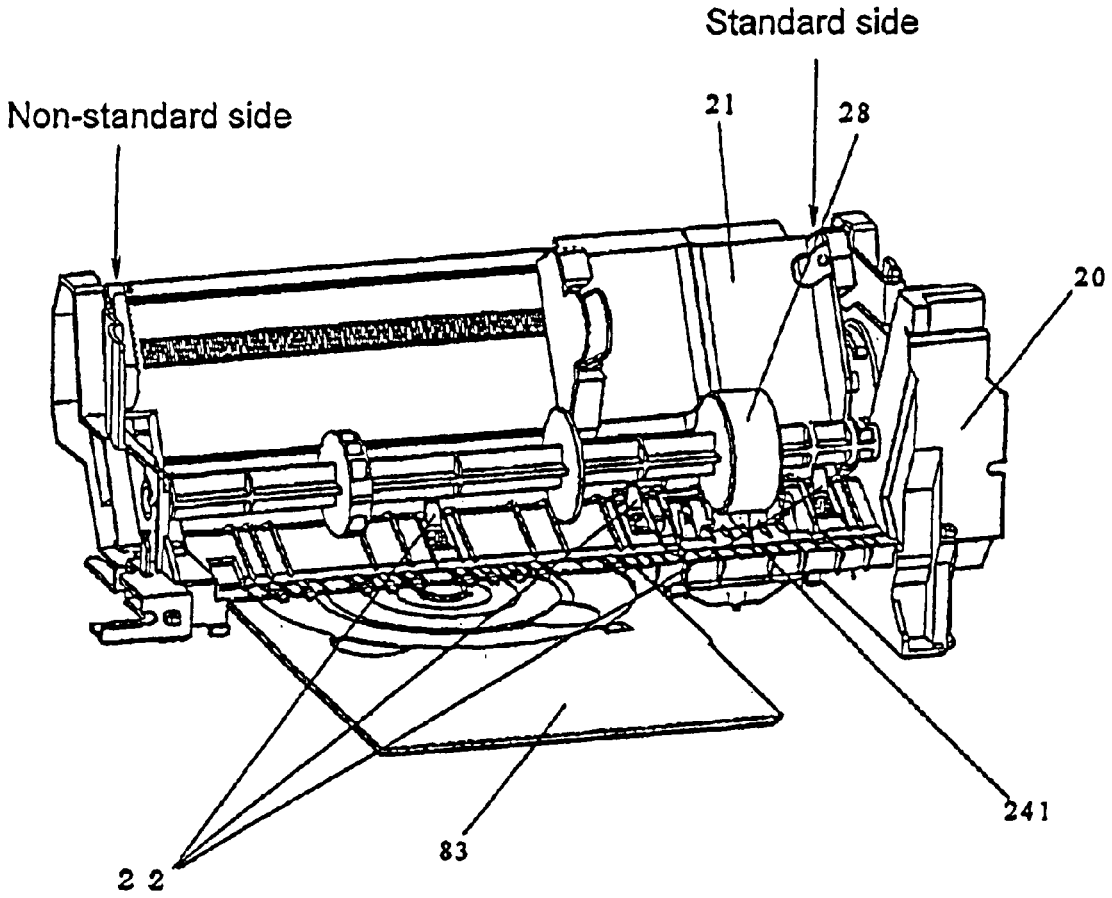
FIG. 18 is a perspective view showing a relation between the feeding section and a CD path according to the first embodiment.
Figure 19:
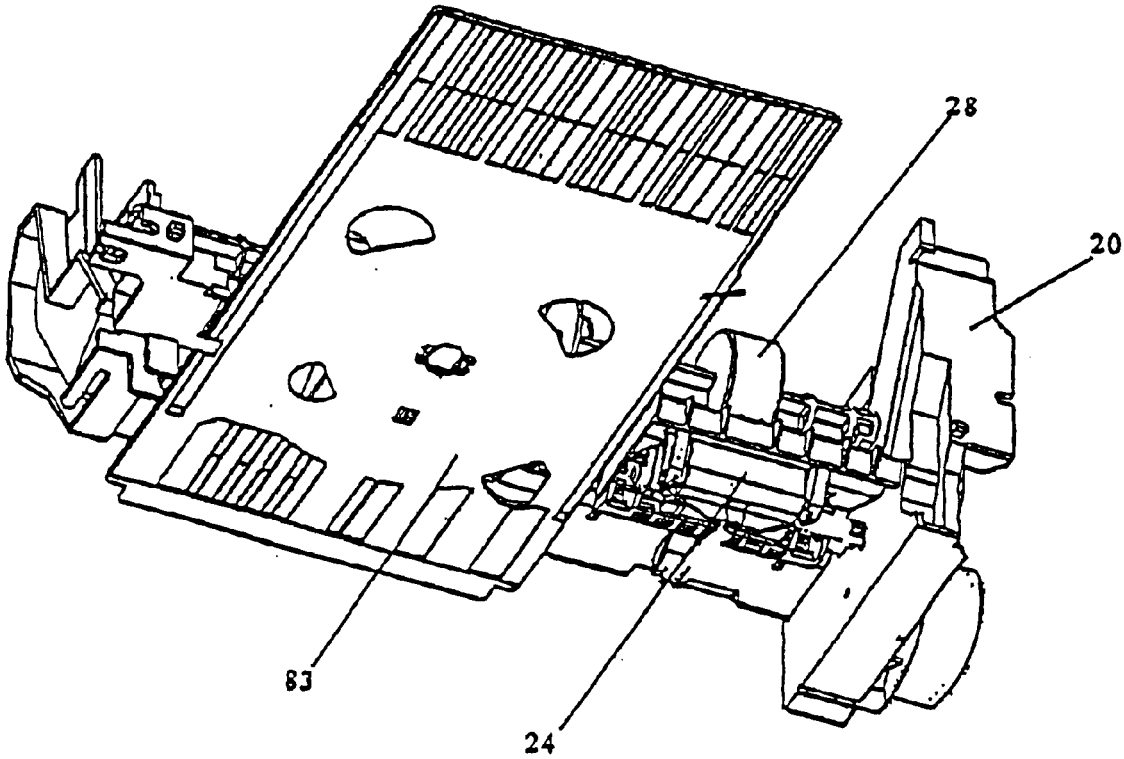
FIG. 19 is a perspective view showing a relation between the feeding section and a CD path according to the first embodiment.
Figure 20:
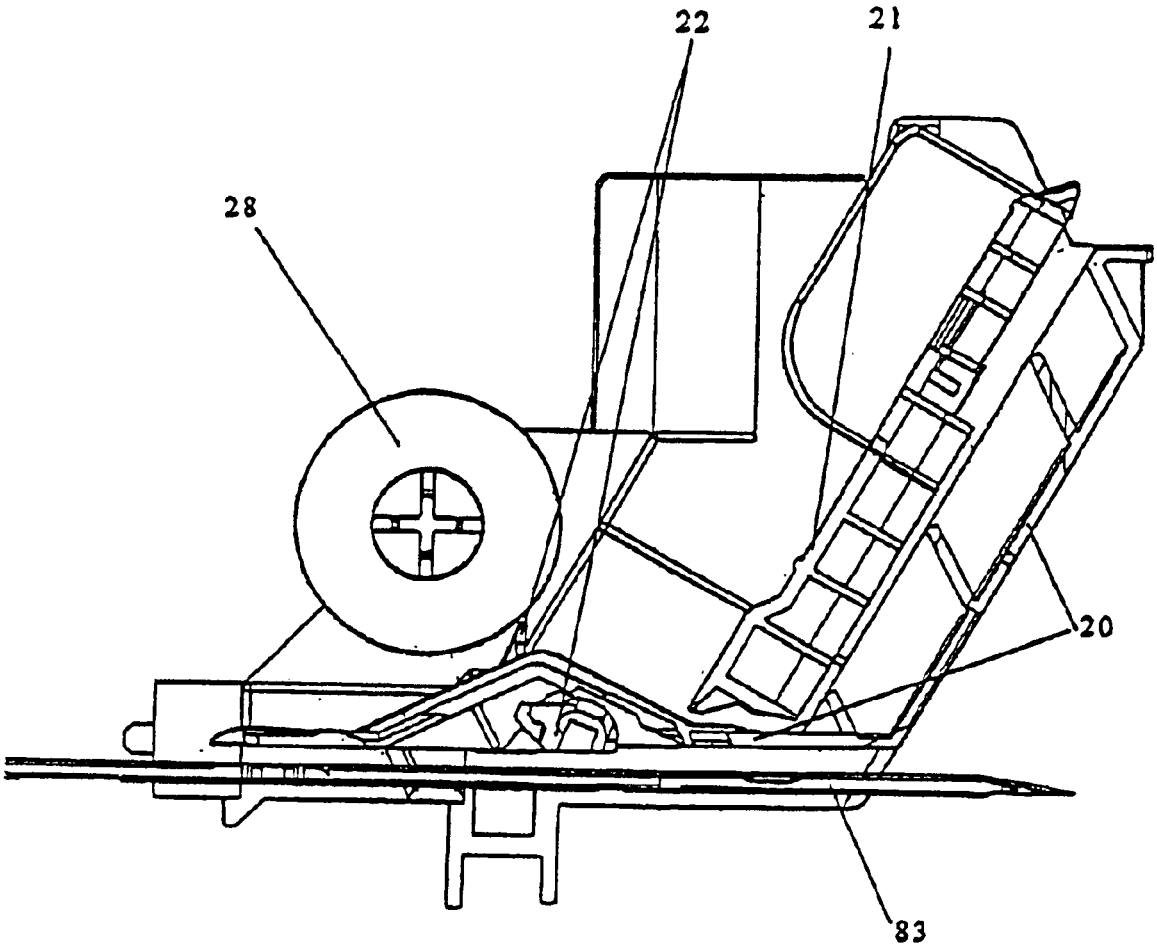
FIG. 20 is a cross-section showing a relation between the returning lever and the tray (during normal CD printing operation) according to the first embodiment.
Figure 21:
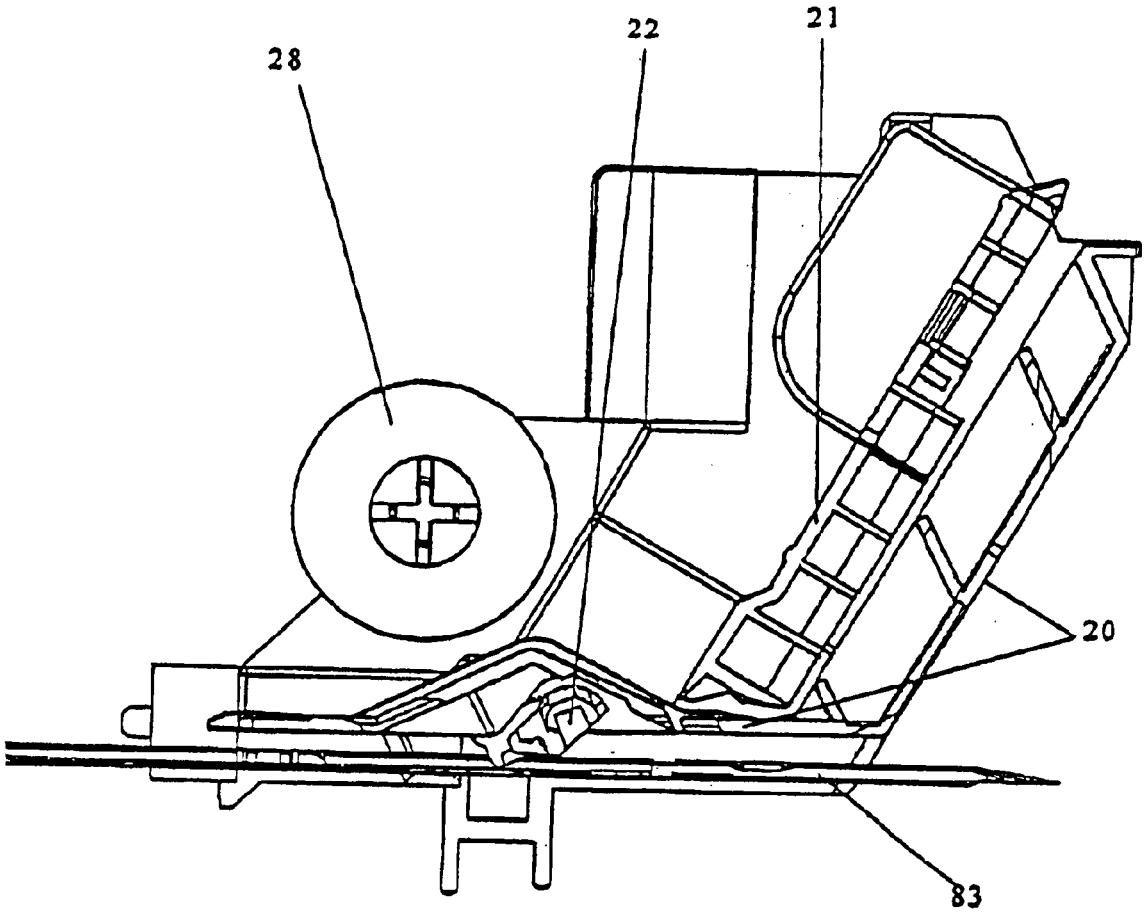
FIG. 21 is a cross-section showing a relation between the returning lever and the tray (at a state that the returning lever is projecting in the tray conveyance route) according to the first embodiment.
Figure 22:
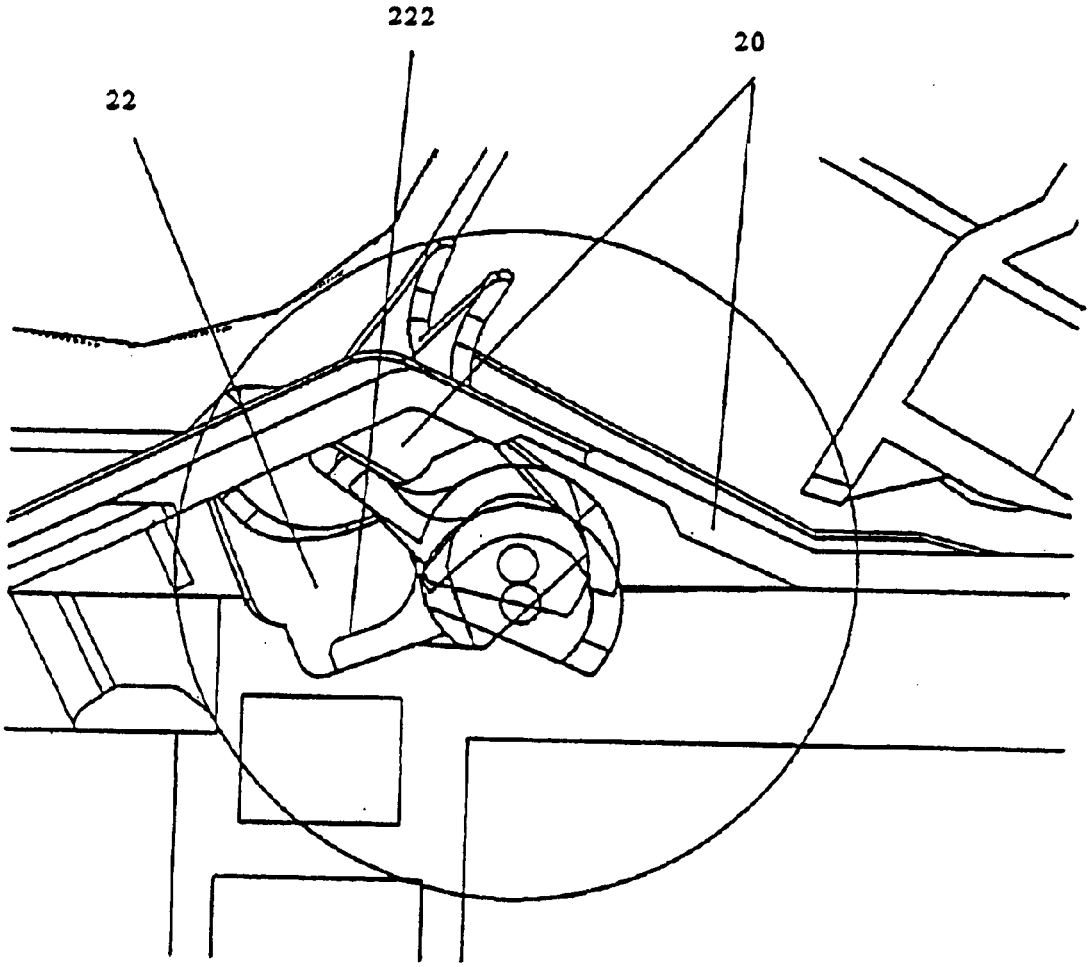
FIG. 22 is a cross-section showing operation of the returning lever according to the first embodiment.

Referring to FIG. 1 to FIG. 22, the first embodiment of the invention is described. FIG. 1 and FIG. 2 are perspective views showing a recording apparatus according to a first embodiment; FIG. 3 and FIG. 4 are perspective views showing a mechanism section of the recording apparatus according to the first embodiment; FIG. 5 is a cross-section showing the recording apparatus according to the first embodiment. FIG. 6 to FIG. 17 are illustrations for CD printing. FIG. 18 and FIG. 19 are perspective views showing a feeding section and a tray for CD printing; FIG. 20 and FIG. 21 are cross-sections showing the feeding section and the tray for CD printing; and FIG. 22 is a cross section showing operation of a returning lever.

The recording apparatus 1 according to this embodiment is formed of, e.g., a feeding section 2, a conveyance section 3, a delivery section 4, a carriage section 5, a cleaning section 6, a recording head 7, and a CD conveyance section 8. Now, the outlines of those sections will be described sequentially.

(A) Feeding Section

The feeding section 2 has a structure that, e.g., a pressing plate 21 for stacking sheet materials (recording materials having a relatively low rigidity such as paper sheets) P, a feeding roller 28 for feeding the sheet material P, a separation roller 241 for separating the sheet material P, and a returning lever 22 as a returning member for returning the sheet material P to a stacking position are attached to a base 20.

The feeding roller 28 has an outer peripheral surface disposed at a position in contact with a common tangent of each roller passing through a contact portion (hereinafter referred to as "nipping portion of the conveyance roller") between a conveyance roller 36 of the conveyance section 3 described below and a pinch roller 37. This is for rendering easy an entry of the sheet material P into the nipping portion of the conveyance roller. This is also to prevent the sheet material from becoming a load upon hitting guides forming the conveyance route when recording is effected on the sheet material P as the sheet path narrows as to precisely detect the front end position of the sheet material P. If a load is given to the sheet material P, the feeding amount at the conveyance roller 36 during recording may be changed, thereby rendering irregular the images.

As shown in FIG. 2, a feeding tray 26 for holding the stacked sheet materials P is attached to the base 20 or an outer housing. The feeding tray 26 is of a multiple stage type and is extended when used.

The feeding roller 28 is of a bar shape with a cross-sectionally annular shape. A separation roller rubber 281 is arranged closer to a sheet material reference side (or the right side when viewed from the apparatus front side, hereinafter referred to as the "reference side" while the opposite side is referred to as the "non-reference side"), thereby feeding the sheet material.

The reason that the separation roller rubber 281 is disposed on a reference side is for a structure in which sheets of a variety of sizes are set to the reference side. This is because many recording objects are written on a sheet surface from a left side to a right side, and because the recording objects are frequently located on the left side of the sheet surface, the apparatus right side corresponding to this is made as the reference. It is desirable to provide a separation portion closer to the reference side when those sheet materials are fed. In an inkjet recording method, a cap is necessary to perform maintenances of the recording head and to prevent the ink from drying. The cap may be possibly arranged on the reference side outside the sheet material passing region, and it is desirable to make recording with reduction of the carriage scanning amount from the region in terms of the recording speed.

Drive to the feeding roller 28 is transmitted by a drive transmission gear 271 and a planetary gear 272 from a special feeding motor 273 formed at the feeding section 2.

A movable side guide 23 is formed movably at the pressing plate 21, thereby limiting the stacking position of the sheet material P. The pressing plate 21 is pivotally movable around a rotary shaft as a center coupled to the base 20 and is urged to the feeding roller 28 by a pressing plate spring 212. A separation sheet 213 (see FIG. 5), made of a material having a large frictional coefficient such as an artificial leather for preventing the sheet materials P located closely to the stacking end from being doubly fed, is formed at the pressing plate 21, facing the feeding roller 28. The pressing plate 21 is structured so as to come in contact with and separate from the feeding roller 28 by the pressing plate cam.

Furthermore, numeral 241 is a separation roller 241 for separating the sheet materials one by one and is attached to the separation roller holder 24. The separation roller holder 24 is pivotally movable around a rotary shaft as a center formed at the base 20. The separation roller 241 is urged to the feeding roller 28 by the separation roller spring. A clutch spring is attached onto a shaft of the separation roller 241, and if a load not less than a prescribed amount is exerted, the separation roller 241 can be rotated.

The separation roller 241 is structured to come in contact with and separate from the feeding roller 28 by a separation roller releasing shaft 244 and a control cam. The positions of the pressing plate 21, the returning lever 22, and the separation roller 241 are detected with an ASF sensor as a first detecting means.

The returning lever 22 for returning the sheet material P to the stacking position is attached so as to be pivotally movable to the base 20 and is urged in a releasing direction with the returning lever spring. The returning lever 22 is structured as to be capable of sliding in a radius direction and is normally urged in a projecting direction with respect to the sheet path with the returning lever spring described above. When the sheet material P is returned, the lever is pivotally moved by the control cam. When the returning lever 22 is pivotally moved so as to return the sheet material P backward, a cam portion 222 (see FIG. 22) formed at the returning lever 22 comes in contact with the base 20, and the returning lever 22 moves to escape from the sheet path of the sheet material P. This is to prevent the conveyance by the conveyance roller during recording which needs an accurate feeding amount from being adversely affected while the sheet material may be subject to a load if the returning lever 22 is in a state protruding in the sheet path. This structure avoids occurrences of irregularity of recording images.

A discharging brush coupled to ground (not shown) is in contact with the feeding roller 28. The feeding roller is always subjected to frictional operation and therefore easily statically charged. Mists of the ink tend to adhere to portions on the feeding roller statically charged as described above. Since the feeding roller contacts with the surface of the recording medium, the adhered mist described above may be transferred to the recording medium. The mechanism thus structured can prevent the feeding roller from being adhered with ink mist and the mist from transferring to the recording medium.

A feeding state using the above structure is described below. In an ordinary waiting state, the pressing plate 21 is separated from the feeding roller 28 by the pressing plate cam (not shown), and the separation roller 241 is separated from the feeding roller 28 by the control cam. The returning lever 22 returns the sheet material P and is formed at a stacking position so as to block the stacking opening so that the sheet material P does not enter the opposite side during the stacking operation.

When feeding of the sheet material begins from this state, the separation roller 241 first comes in contact with the feeding roller 28 by drive of the motor. The returning lever 22 is then disengaged to render the pressing plate 21 in contact with the feeding roller 28. Feeding of the sheet material P then begins in this state. The sheet material P is restricted with a front stage separation portion 201 formed at the base 20, and a prescribed number of the sheet materials P only are fed to a nipping portion formed of the feeding roller 28 and the separation roller 241. The sheet materials P thus fed are separated at this nipping portion, and only the topmost sheet material P is conveyed.

When the sheet material P reaches the conveyance roller 36 and the pinch roller 37 as described below, the pressing plate 21 is separated from the feeding roller 28 by the pressing plate cam. The separation roller 241 is separated from the feeding roller 28 by the control cam. The returning lever 22 is returned to the stacking position by the control cam. The sheet material that has reached the nipping portion formed of the feeding roller 28 and the separation roller 241 can be returned to the stacking position at that time.

(B) Conveyance Section

Next, a conveyance section is described. The conveyance section 3 is attached to a chassis 11 made of a bent metal plate. The conveyance section 3 has a conveyance roller 36 for conveying the sheet materials P and a PE sensor as a second detecting means. The conveyance roller 36 has a structure of fine ceramic particles coated on a surface of a metal axis, is received by bearings at metal portions of both axes, and is attached to the chassis 11. A conveyance roller tension spring is formed at the conveyance roller 36 between the bearing and the conveyance roller 36 to provide a load during rotation and to enable stable conveyance, and stable conveyance can be effected upon providing the load to the conveyance roller 36 during rotation.

Plural pinch rollers 37 driven by the conveyance roller 36 are formed so as to contact to the conveyance roller 36. Each pinch roller 37 is held by a pinch roller holder 30 and is urged to the conveyance roller 36 by the pinch roller spring, thereby producing a conveyance force for the sheet material P. The rotary shaft of the pinch roller holder 30 is attached to the bearing of the chassis 11 at that time, and the pinch roller holder 30 rotates around the shaft.

A paper guide flapper 33 for guiding the sheet material P and a platen 34 are arranged at an entrance of the conveyance section 3 to which the sheet material P is conveyed. A PE sensor lever 321 is formed at the pinch roller holder 30 to transmit the detection of the front end and rear end of the sheet P to the PE sensor 32. The platen 34 is attached to the chassis 11 and secured at a proper position.

The paper guide flapper 33 fits in the conveyance roller 36 and is rotatable around the bearing as a center with which the roller is in sliding contact. The flapper 33 is urged upward (in a counterclockwise direction in FIG. 5) by a spring, and is positioned by contacting the chassis 11. This state makes a lower sheet guide when a sheet material P having a relatively low rigidity is conveyed from the feeding section, but a highly rigid tray 83 is inserted from a downstream side during the CD conveyance as described below. In this case, the paper guide flapper 33 rotates in the clockwise direction by the tray 83 supported substantially horizontally with the conveyance roller 36 and the delivery rollers 40, 41, thereby not disturbing the motion of the tray. The spring force is designed as to satisfy this operation.

A sheet material pressing member covering the end of the sheet material P is formed on a sheet material reference side of the platen 34. This member prevents a sheet material P, whose end is transformed or curled, from interfering with a carriage 50 or the recording head 7 even when the end floats. The recording head for forming images based on the image information is formed on a downstream side in the sheet material conveyance direction of the conveyance roller 36.

In this structure, the sheet material P sent to the conveyance section 3 as described above is guided by the pinch roller holder 30 and the paper guide flapper 33, and sent to a roller pair of the conveyance roller 36 and the pinch roller 37. At that time, the PE sensor lever 321 detects the front end of the sheet material P thus conveyed, thereby determining recording position of the sheet material P.

The sheet material P is conveyed on the platen 34 according to rotation of the roller pair 36, 37 from the conveyance motor 35. Ribs are formed on the platen 34 to serve as a conveyance reference surface to manage the gap with the recording head 7. It is structured not to wrinkle the sheet material P by controlling the ripples of the sheet materials with the platen 34 and the delivery section described below.

The conveyance roller 36 is driven by transmitting the rotational force of the conveyance motor 35 comprised of a DC motor to a pulley 361 formed on a shaft of the conveyance roller 36 with a timing belt. A code wheel 362, on which marking is formed with 150 lpi through 300 lpi to detect the conveyance amount conveyed by the conveyance roller 36, is formed on the shaft of the conveyance roller 36. An encoder sensor 363 for reading the marking is attached to the chassis 11 at a position adjacent to the code wheel 363.

(C) Carriage Section

The carriage section 5 has a carriage 50 for attaching the recording head 7. The carriage 50 is supported to a guide shaft 52 for reciprocally scanning the carriage in a direction intersecting with the conveyance direction of the sheet material P and to a guide rail 111 holding the end of the carriage 50 to maintain the gap between the recording head 7 and the sheet material P. The guide shaft 52 is attached to the chassis 11. The guide rail 111 is formed in a united body with the chassis 11. A sliding sheet 53 made of a thin plate such as of SUS or the like is formed with tension on a sliding side for the carriage 50 of the guide rail 111, thereby reducing sliding noises.

The carriage 50 is driven via a timing belt 541 by a carriage motor attached to the chassis 11. The timing belt 541 is tensioned by and supported on an idling pulley 542. The timing belt 541 is coupled to the carriage 50 through a damper made of a material such as rubber or the like, thereby reducing irregularity in images upon attenuation of vibration of the carriage motor and the like.

A code strip 561 formed with a marking of a pitch of 150 lpi through 300 lpi to detect the position of the carriage 50 is arranged parallel to the timing belt 541. An encoder center for reading the marking is formed on a carriage substrate mounted on the carriage 50. A connector for electrically connecting the recording head 7 is also formed on the carriage substrate. The carriage 50 also has a flexible substrate 57 for transmitting a head signal from an electrical substrate 91 to the recording head 7.

The carriage 50 is formed with a hitting portion for positioning the recording head 7 and a pushing means for pushing the head to be secured in order to secure the recording head 7 to the carriage 50. The pushing means is mounted on the head set lever 51 and is structured to operate on the recording head 7 when set upon rotating the head set lever 51 around a rotary center.

Figure 16:
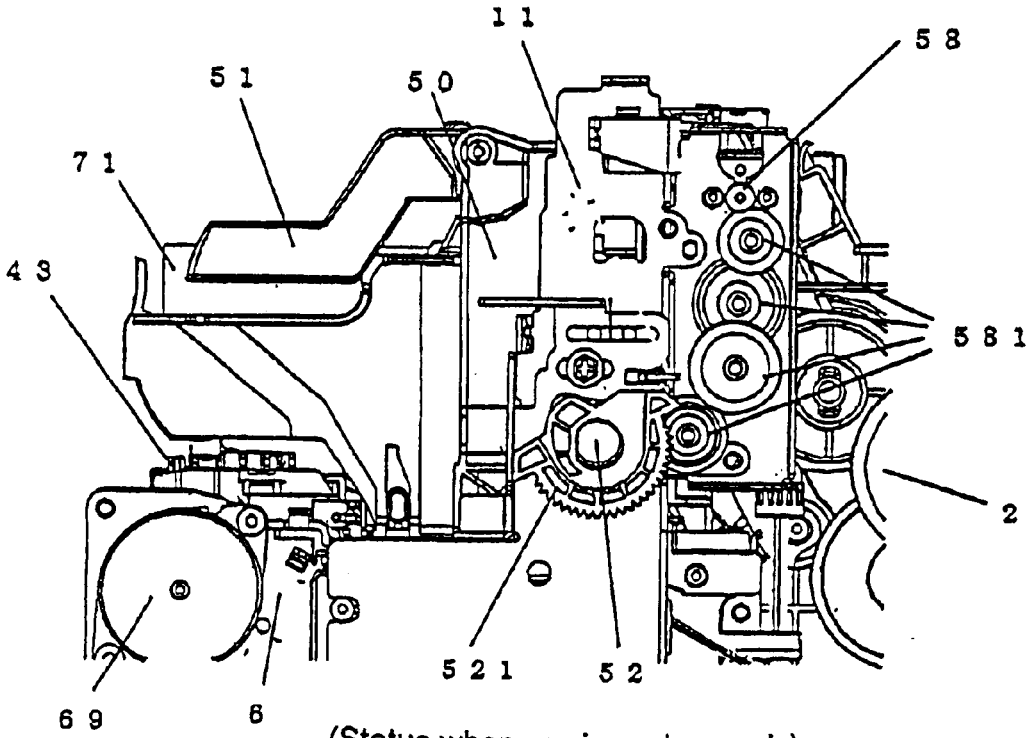
FIG. 16 comprises illustrations showing a carriage guide shaft up and down moving mechanism according to the first embodiment.
Figure 16:
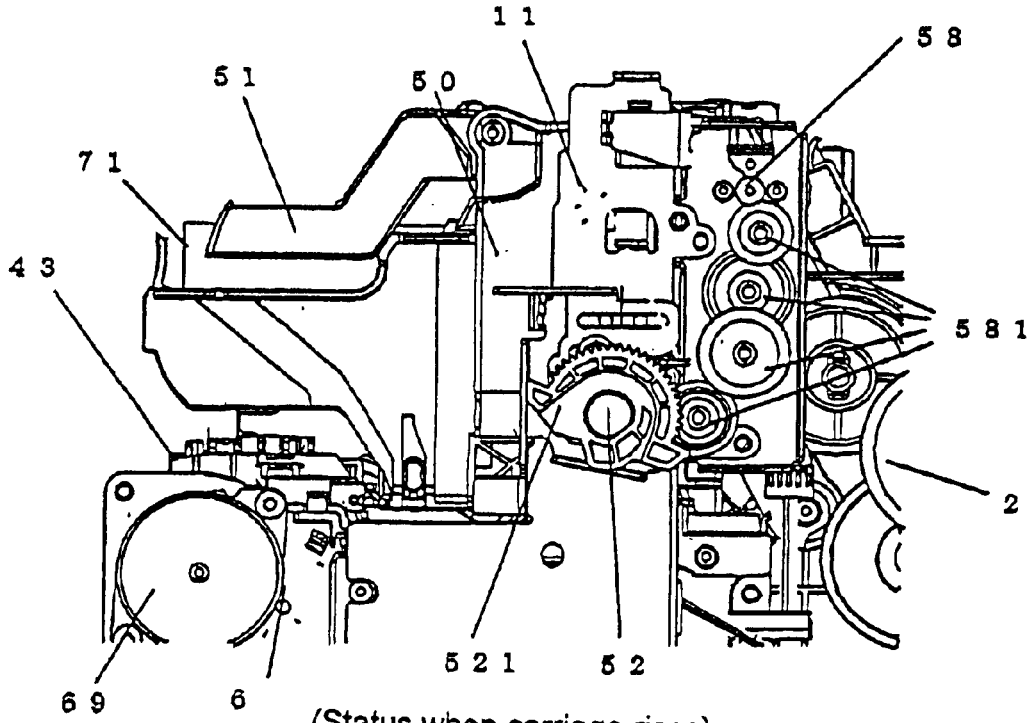

As shown in FIG. 16, an eccentric cam 521 is provided on each end of a guide shaft 52, and the guide shaft 52 can be moved up and down upon transmitting drive to the eccentric cam 521 through a gear series 581 from drive of a carriage lifting motor 58. This structure moves the carriage 50 up and down and forms an optimum gap to sheet materials P having a thickness different from each other.

A tray position detection sensor (fourth detection means) made of a reflective type optical sensor for detecting a mark 834 (see, FIG. 13) for position detection of the tray 83 for the CD printing described below is attached to the carriage 50. The position of the tray 83 can be detected by emitting light from a light emitting device and receiving the reflected light.

The recording head 7 is used with an inkjet recording head on which replaceable ink tanks separately provided for each color are mounted. A discharging structure for ink of the recording head 7 effects recording upon energizing an electro-thermal converter in response to the recording signal and then discharging ink through an orifice according to growth and contraction of bubbles generated in the ink by utilizing film boiling generated in the ink from the thermal energy. By discharging ink in this way upon growing and contracting the bubble by the thermal energy, liquid discharge with good response property can be particularly achieved.

It is to be noted that, in recording with the inkjet method, it is desirable to eject the ink in a gravity direction, so the platen 34 is desirably positioned horizontally. It is desired that the sheet material P is entered in an inclined manner (10 to 15 degrees) relative to the platen 34 to render the sheet material P closely in contact with the platen 34 so that the sheet material P is not afloat at the recording section during conveyance. It is therefore desirable that the feeding roller nipping is inclined, and accordingly, the feeding roller 241 of the feeding section is desirably disposed upward as described above.

With this structure, when images are formed on the sheet materials P, the roller pair 36, 37 conveys the sheet material P to a row position for image formation (position in the conveyance direction of the sheet material P), and the carriage 50 is moved by the carriage motor to a column position for image formation (a position perpendicular to the conveyance direction of the sheet material P), thereby rendering the recording head 7 at a position facing the image forming position. Then, the recording head 7 according to the signal from the electric substrate 91 discharges ink to the sheet material P, thereby forming images.

(D) Delivery Section

The delivery section 4 is formed of two delivery rollers 40, 41, spurs 42 driven to rotate in contact with the delivery rollers 40, 41 with a prescribed pressure, a gear series for transmitting the drive of the conveyance roller to the delivery rollers 40, 41, and the like.

The delivery rollers 40, 41 are attached to the platen 34. The delivery roller 40 on the upstream side is formed with a plurality of rubber portions on a metal shaft. The drive from the conveyance roller is transmitted to the delivery roller 40 via the idler gear to drive the roller. The delivery roller 41 has a structure such that elastic body portions made of an elastomer are attached to a resin shaft. The drive to the delivery roller 41 is transmitted from the delivery roller 40 via the idler gear.

The spur 42 is formed of a SUS-made thin plate having plural projections on a peripheral surface thereof and a resin portion unitedly formed to the plate, and is attached to a spur holder 43. A spur spring provided as a bar shaped coil spring renders the spur 42 attached to the spur holder 43 and pushes the spur 42 to the delivery rollers 40, 41. The spur is provided at a position corresponding to the rubber portions and the elastic body portions of the delivery rollers 40, 41, thereby producing the conveyance force for the sheet material P, as well as mainly suppressing floating of the sheet material during recording when at a position where no rubber portion and no elastic body portion of the delivery rollers 40, 41 are provided.

An end support for sheet material is provided between the delivery rollers 40, 41 to avoid damage by rubbing recorded portions of the sheet materials P by lifting each opposite end of the sheet material P and holding the sheet material P at a front side of the delivery rollers 40, 41. A resin member at a tip of which a roller is formed is urged by an end support spring of the sheet material; each end of the sheet material P is lifted by pushing the roller to the sheet material P with a prescribed pressure, thereby structuring the support as to hold the sheet material with rigidity of the sheet material.

With the structure thus described, the sheet material P, on which images are formed with the carriage section 5, is nipped between the delivery roller 41 and the spur 42, and thereby delivered to a delivery tray 46 after conveyance. The delivery tray 46 is divided into plural sections and is structured to be contained below a lower casing 99 described below. The delivery tray 46 is pulled open when used. The delivery tray 46 is structured to increase in height toward its tip and to render the tip at the end of each segment higher than a previous segment, thereby improving the stacking property of the delivered sheet material P as well as preventing the recording surface from wearing.

(E) Cleaning Section

The cleaning portion 6 is structured, as shown in FIG. 3 and FIG. 4, of, e.g., a pump 60 for performing cleaning of the recording head 7, a cap 61 for suppressing drying of the recording head 7, and a blade 62 for cleaning a face of a surface around the nozzles of the recording head 7.

The cleaning portion 6 has an exclusively used cleaning motor 69, and one-way clutch so as to operate the pump with rotation in one direction and to operate the blade 62 as well as move the cap 61 up and down with rotation in the other direction.

The pump 60 generates negative pressure upon pressing two tubes with a pumping roller. The cap 61 is connected to the pump by a tube via a valve placed in a midway region. It is structured that unnecessary inks can be sunctioned from the recording head 7 if the pump 60 is operated as the cap 61 is closely in contact with the recording head 7. A cap absorber is formed in a portion of the cap 61 to reduce remaining ink on the surface of the recording head 7 after the head is sunctioned. The ink remaining in the cap 61 is absorbed while the cap 61 is opened so that the ink does not remain to adversely affect the head by adhering in a solid state. The waste ink sunctioned by the pump 60 is absorbed by a waste ink absorbing body 991 (see, FIG. 9 and FIG. 11) formed at the lower casing 99 as described below.

A series of operations, such as operation of the blade 62, operation of up and down movement of the cap 61, opening and closing of the midway valve, is controlled by a main cam formed with a plurality of cams on a shaft. Cams and arms at each portion are operated by the main cam to effect the prescribed operations. The position of the main cam can be detected by the position detection sensor such as a photo-interrupter or the like. When the cap 61 is moved down, the blade 62 moves perpendicularly to the scanning direction of the carriage 50, thereby cleaning the nozzle vicinity of the recording head 7. The blades 62 are provided in a plural number including one for cleaning the nozzle vicinity of the recording head 7 and one for cleaning the entire surface. When the blade 62 is moved to the rearmost position, the ink adhering to the blade 62 itself can be removed upon contacting to the blade cleaner 66.

(F) Housing Section

The respective units described above are incorporated in the chassis 11 to form a mechanism portion of the printer. A housing is attached as to cover the periphery of the portion. The housing is, as shown in FIG. 1 and FIG. 2, made of mainly the lower casing 99, an upper casing 98, an access cover 97, a connector cover 96, and a front cover 95.

A delivery tray rail is formed below the lower portion of the lower casing 99, and the divided delivery tray 46 is so structured as to be containable. The front cover 95 is structured to cover the delivery outlet when not in use.

An access cover 97 is attached to the upper casing 98 and is structured to be rotatable. A part of the upper surface of the upper casing 98 has an opening, and the ink tank 71 and the recording head 7 are structured to be replaceable at that location. Furthermore, a door switch lever for detecting opening and closing of the access cover, an LED guide 982 for transmitting and displaying a beam of an LED, a key switch 983 operating to switch on the substrate, etc. are formed on the upper casing 98. A feeding tray 26 of multiple stage type is rotatably attached to the upper casing 98. When the feeding section is not used, the feeding tray 26 is structured to become a cover of the feeding section when in a storaged position. In addition, the upper casing 98 and the lower casing 99 are attached with fitting tongs having elasticity. A connector cover 96 covers a portion at which the connectors are provided between the casings.

[Relation Between the CD Conveyance Section 8 and the Feeding Section 2]

The relation between the CD conveyance section 8 and the feeding section 2 will now be described. Referring to FIG. 6 to FIG. 17, the CD conveyance section 8 according to this embodiment and CD printing using this section will be described in detail.

Figure 6:
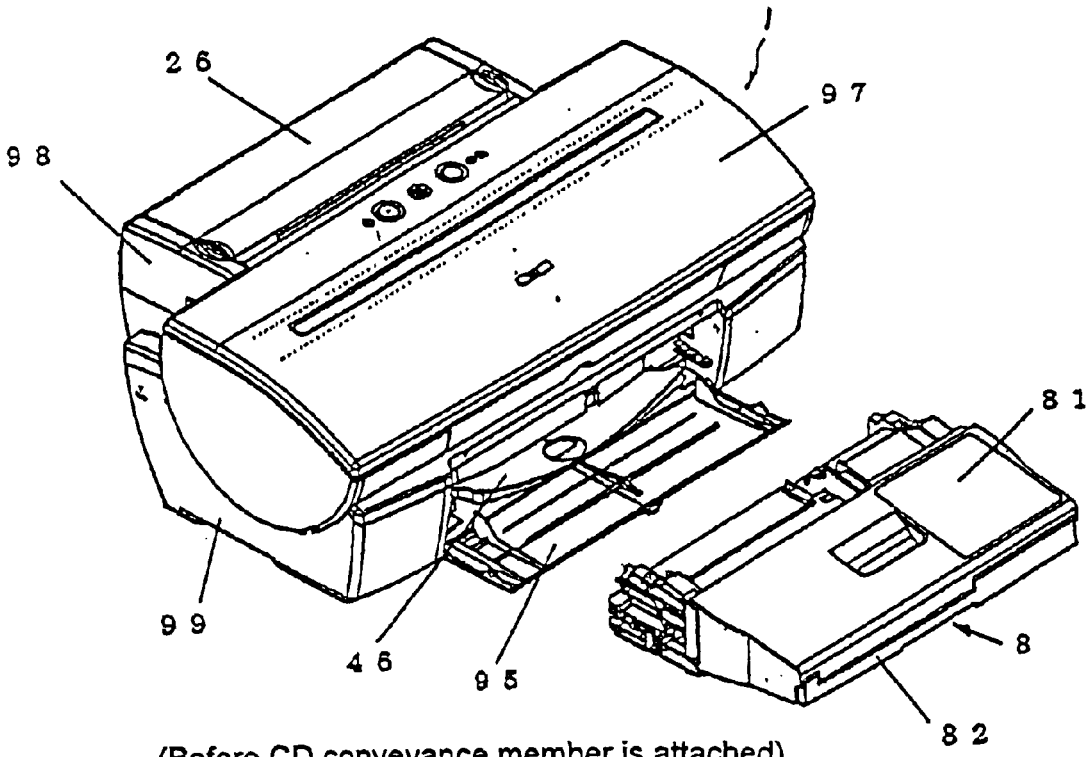
FIG. 6 comprises perspective views showing the recording apparatus according to the first embodiment.
Figure 6:
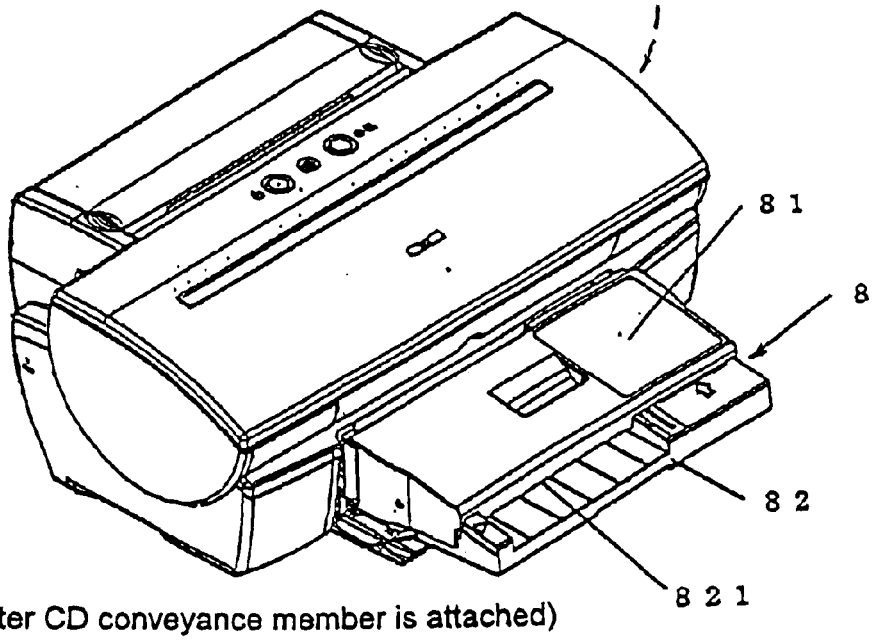
Figure 7:
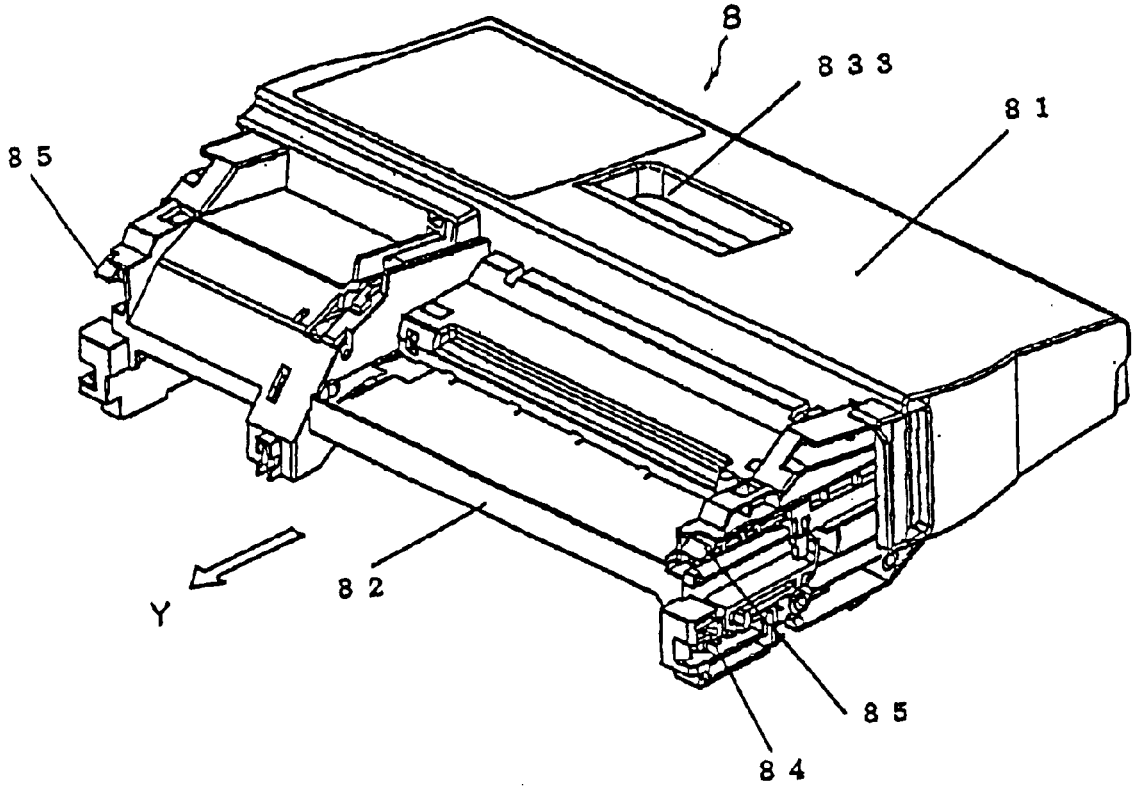
FIG. 7 is a perspective view showing a CD conveyance portion according to the first embodiment.
Figure 8:
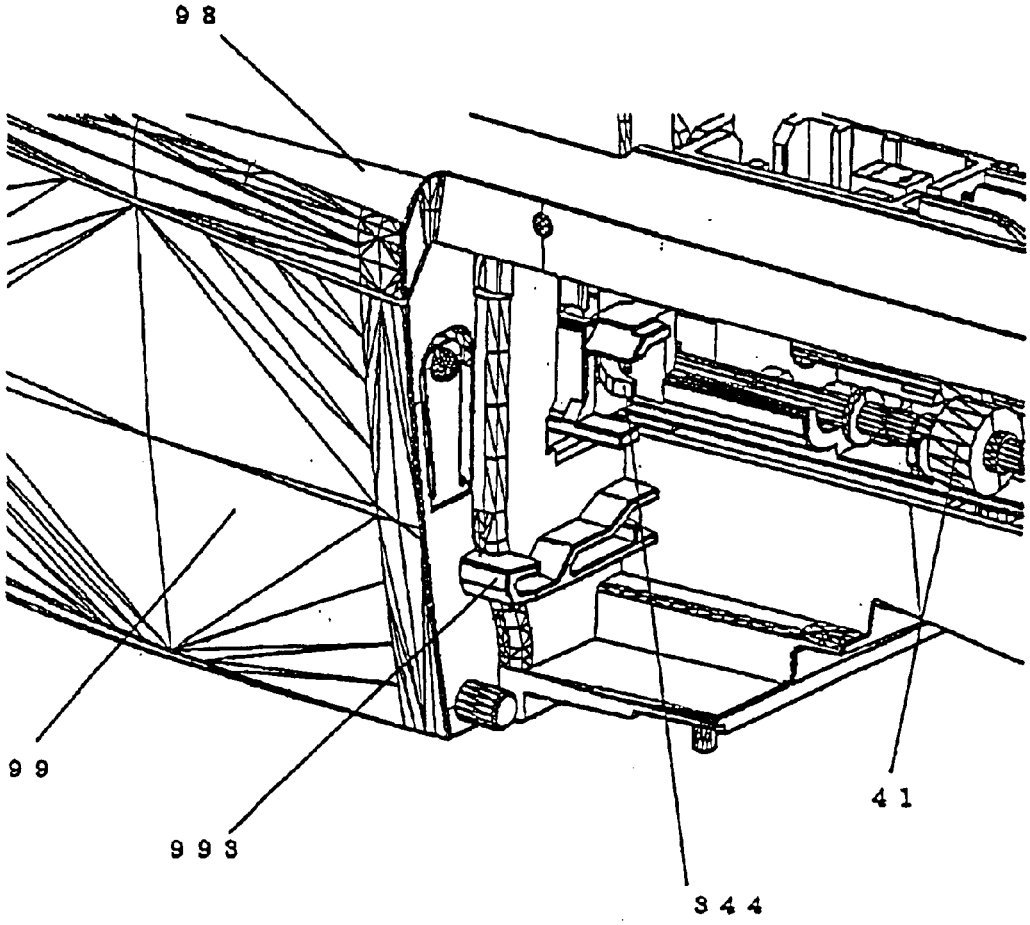
FIG. 8 is a perspective view showing an attachment portion and an attachment detection portion of the CD conveyance portion at a lower casing according to the first embodiment.
Figure 9:
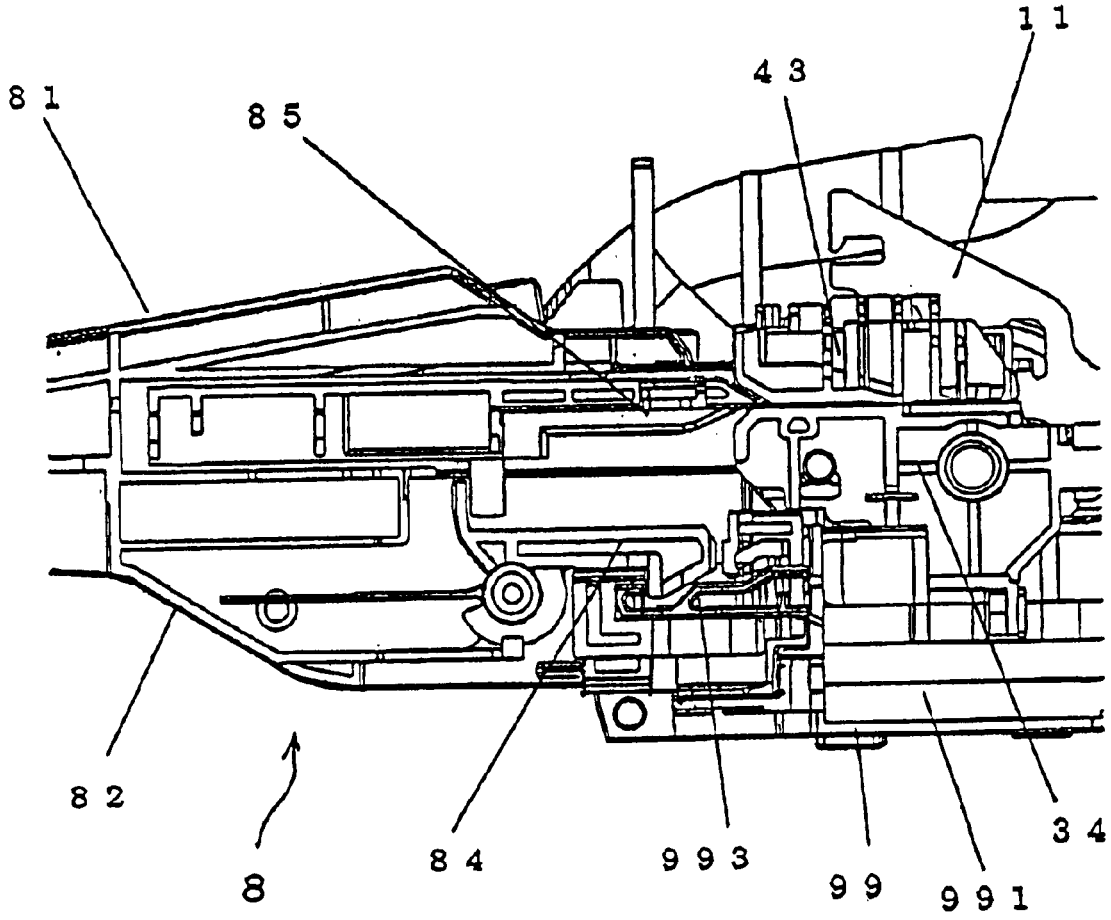
FIG. 9 is a structural illustration showing a hooking engagement between the lower casing and the CD conveyance portion according to the first embodiment.
Figure 10:
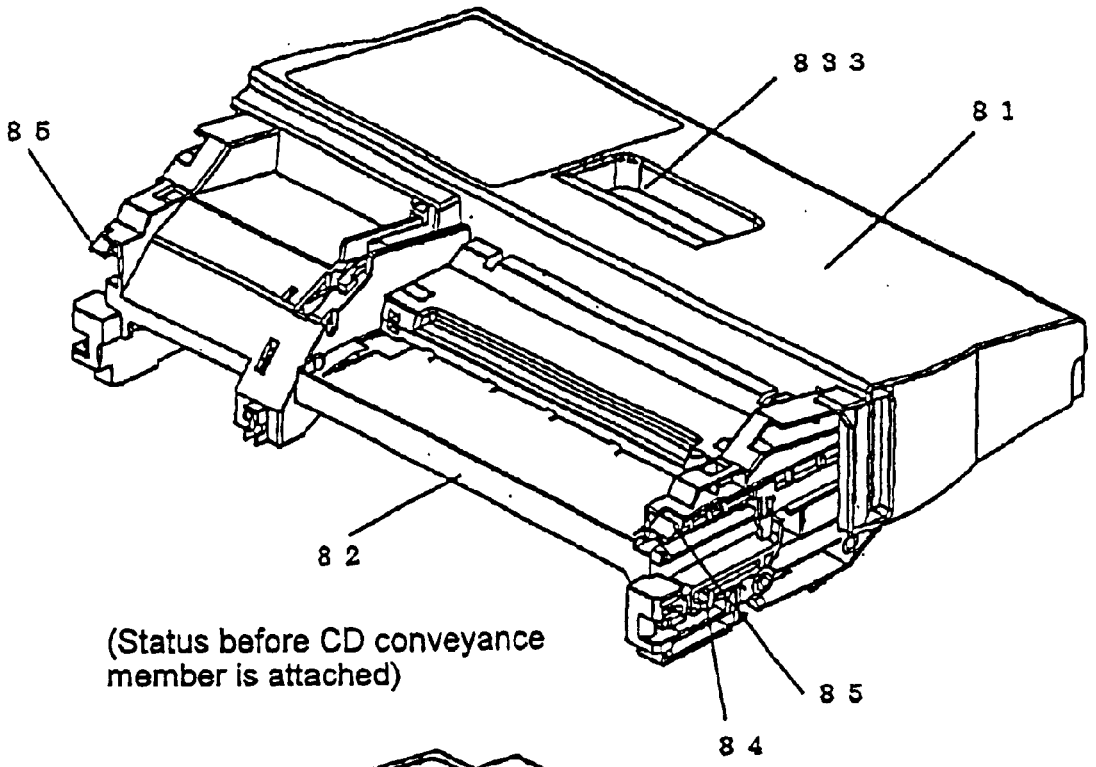
FIG. 10 comprises perspective views showing the CD conveyance portion where a sliding cover is moved according to the first embodiment.
Figure 10:
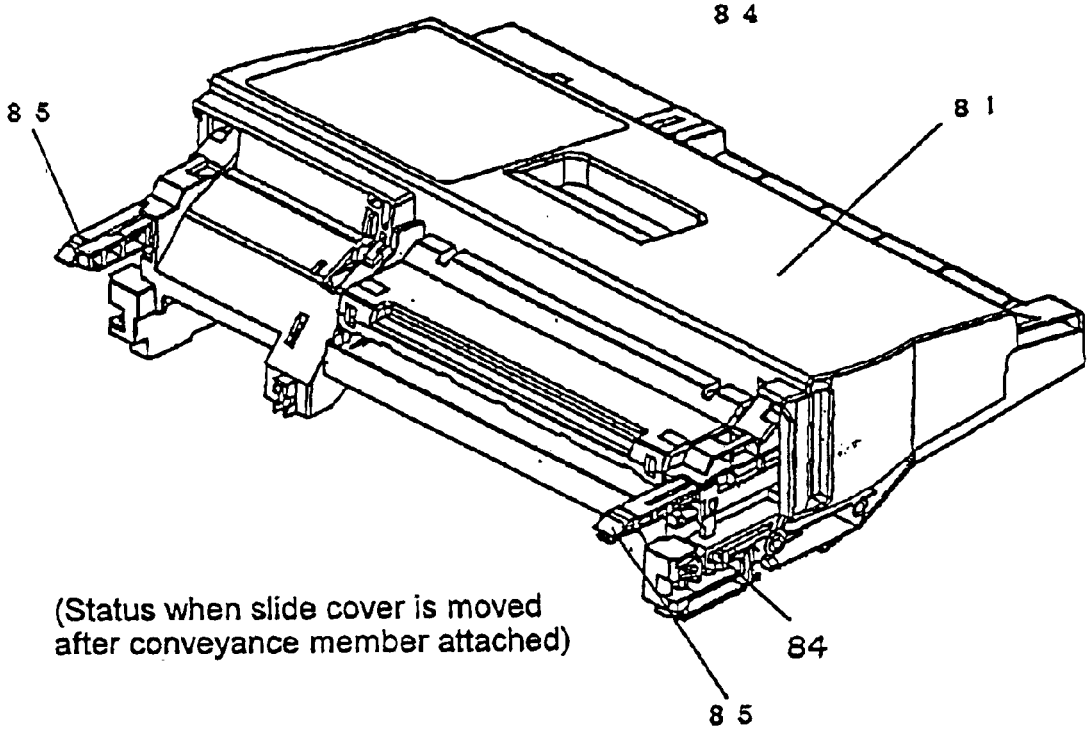
Figure 11:
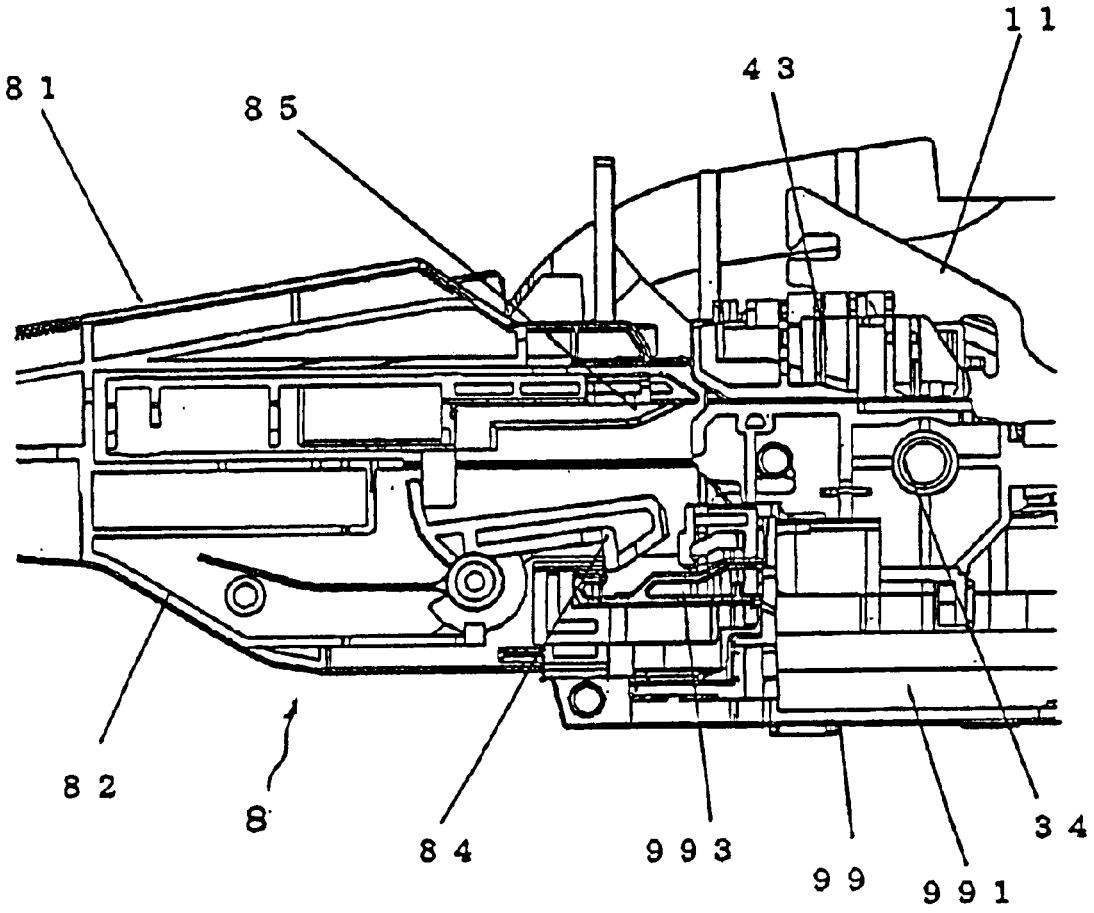
FIG. 11 is a structural illustration showing a hooking disengagement between the lower casing and the CD conveyance portion according to the first embodiment.
Figure 12:
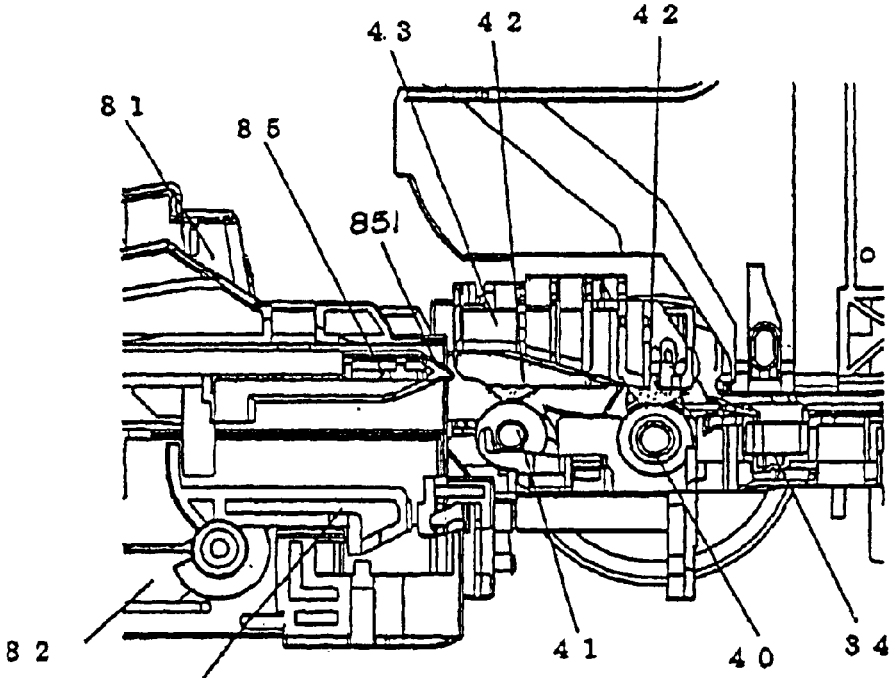
FIG. 12 comprises structural illustrations showing an arm where the sliding cover is moved according to the first embodiment.
Figure 12:
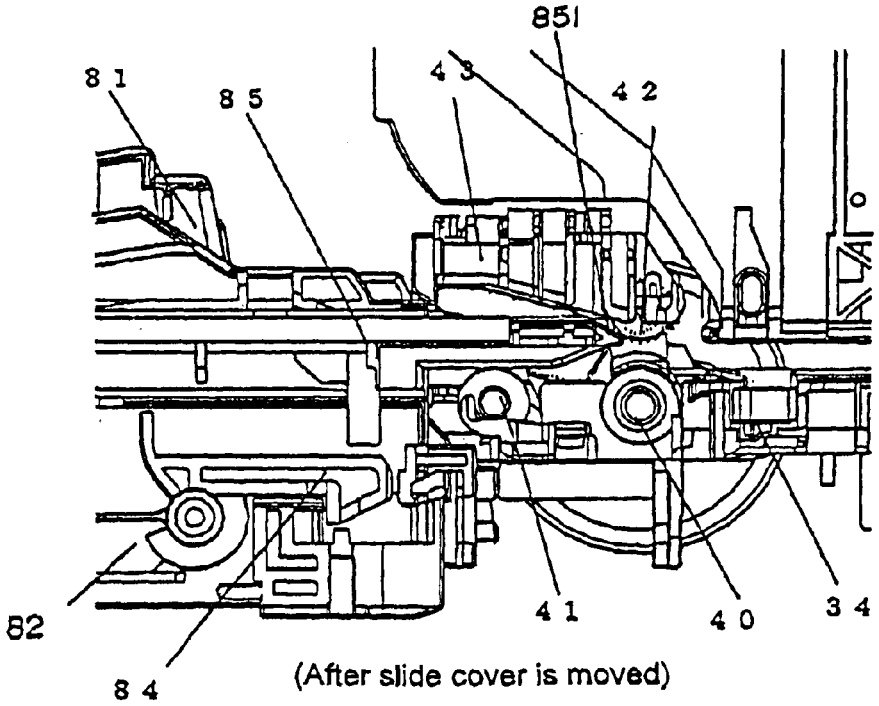
Figure 13:
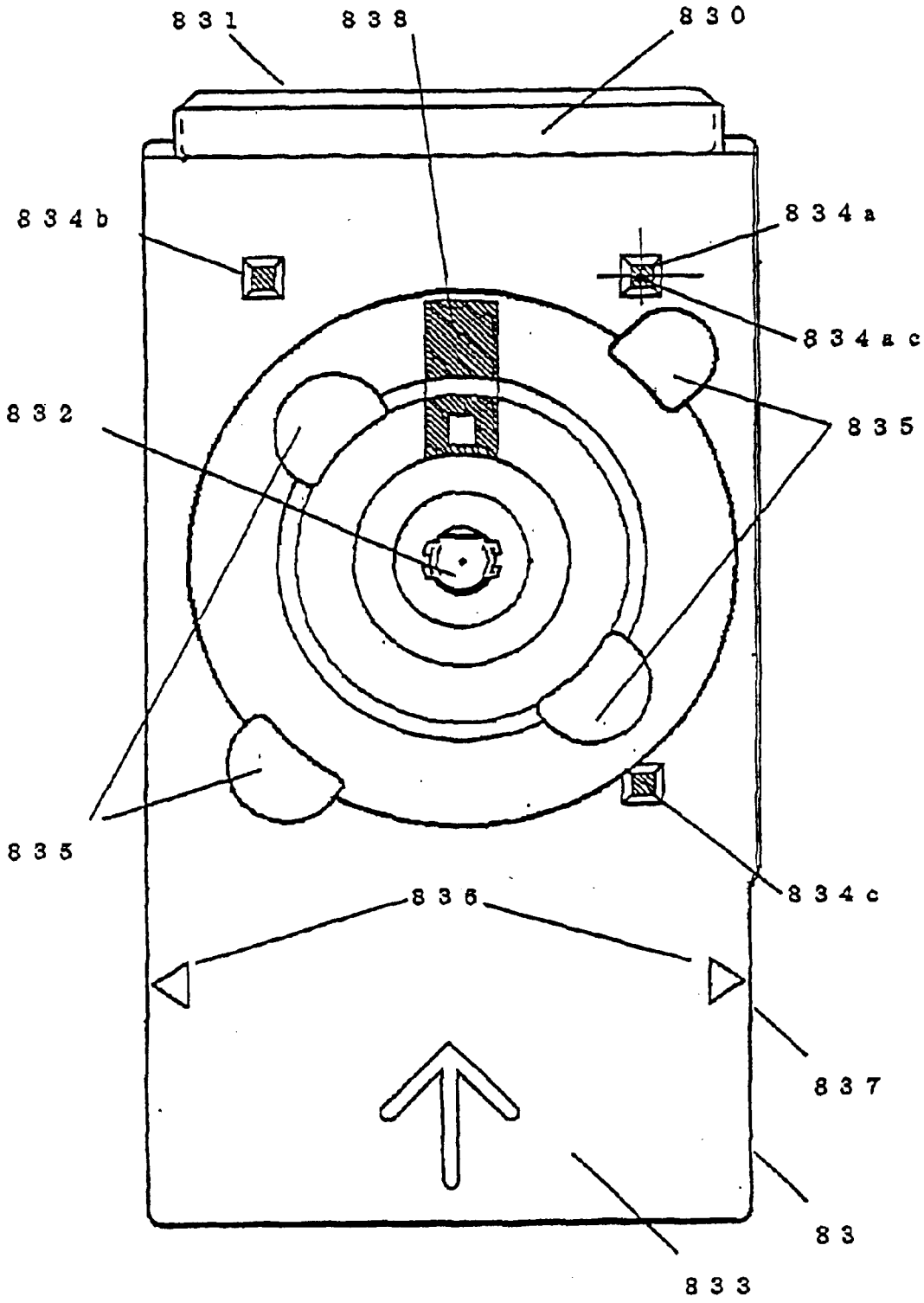
FIG. 13 is a plan view showing a tray according to the first embodiment.
Figure 14:
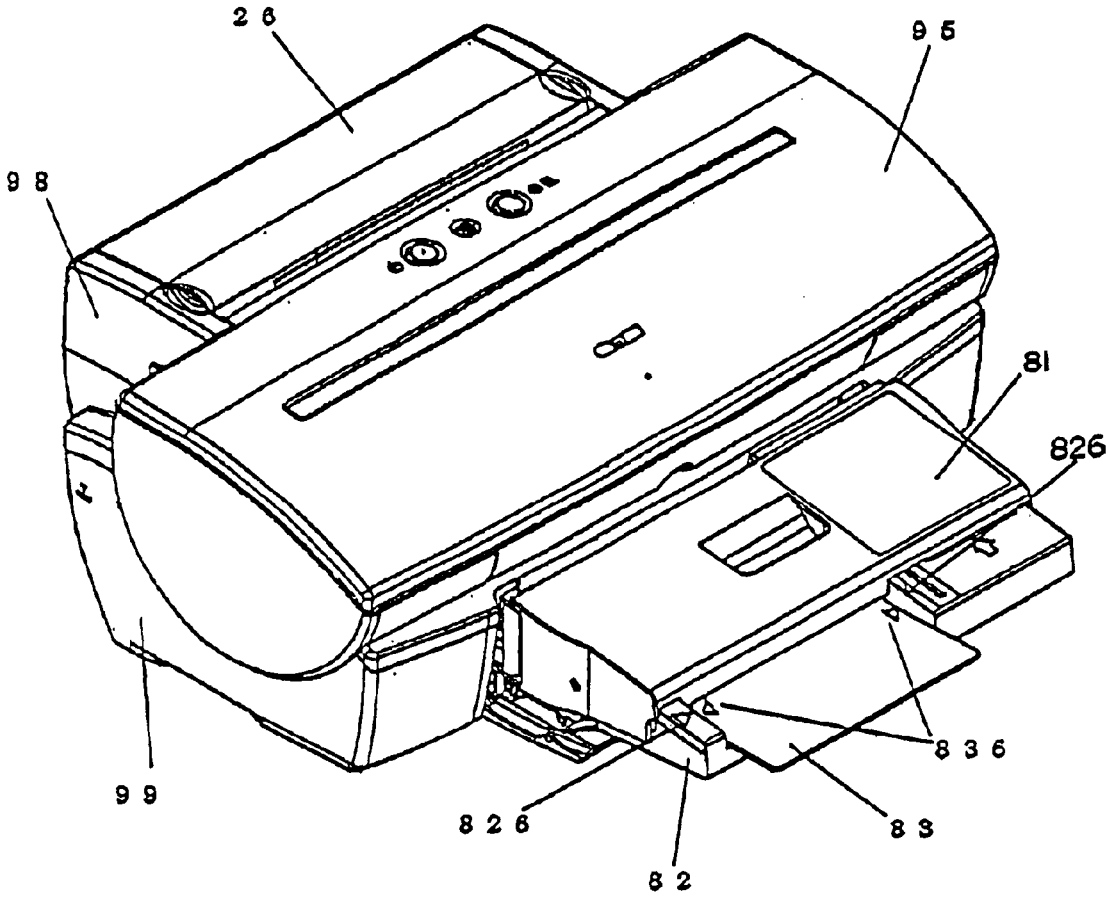
FIG. 14 is a perspective view showing the tray set to the CD conveyance portion according to the first embodiment.
Figure 15:
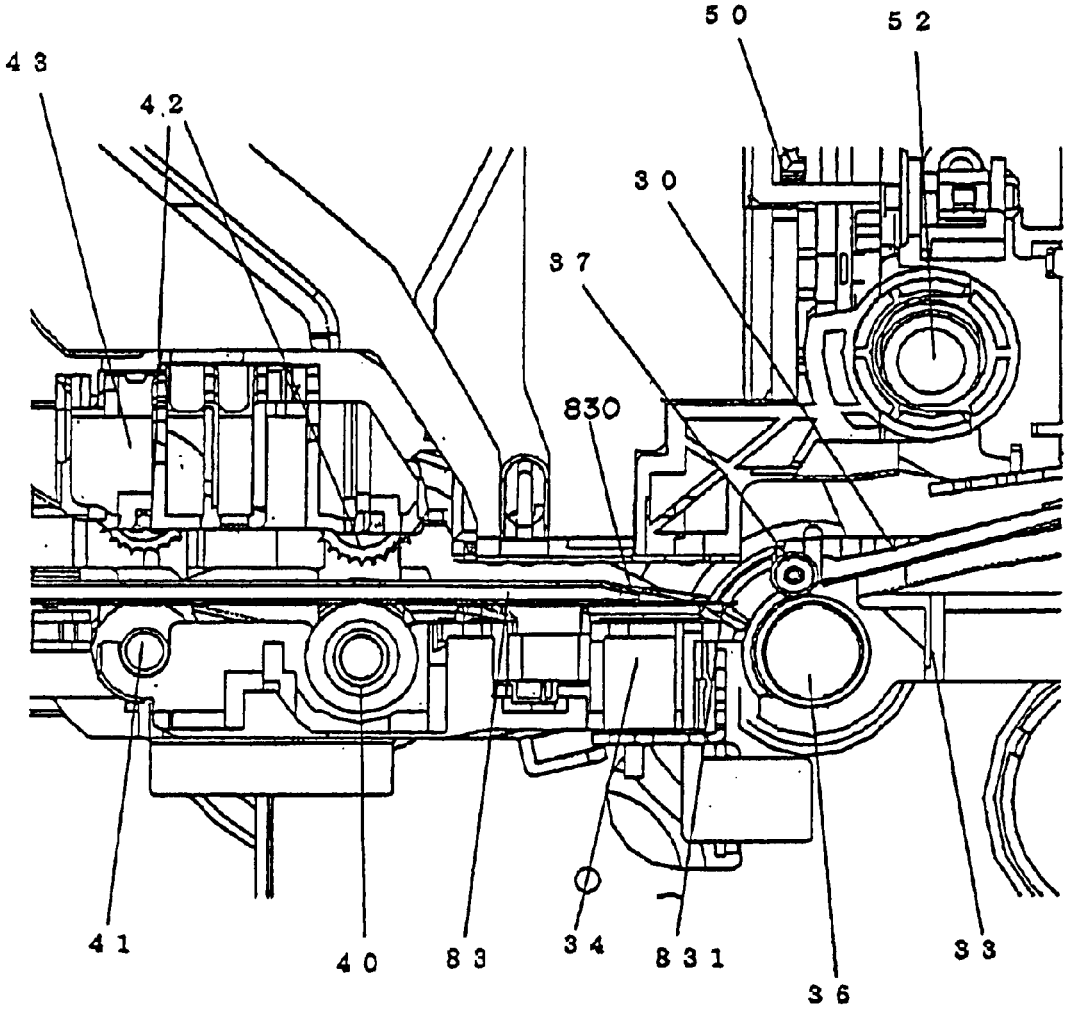
FIG. 15 is an illustration showing conveyance of the tray according to the first embodiment.

FIG. 6 comprises perspective views in which the CD conveyance section 8 is attached to the recording apparatus body; FIG. 7 is a perspective view of the CD conveyance section 8; FIG. 8 is a structural view of an attachment portion of the CD conveyance section 8 at the lower casing 99 and an attachment detecting portion; FIG. 9 is a structural illustration showing an engagement of the lower casing 99 and a hook 84 of the CD conveyance section 8; FIG. 10 comprises perspective views of the CD conveyance section 8 where the sliding cover 81 is moved; FIG. 11 is a structural illustration showing a disengagement between the lower casing 99 and the hook 84 of the CD conveyance section 8; FIG. 12 comprises perspective views of an arm 85 where the sliding cover 81 is moved; FIG. 13 is a plan view of the tray 83; FIG. 14 is a perspective view in which the tray 83 is set to the CD conveyance section 8; FIG. 15 is an illustration for conveyance of the tray 83; FIG. 16 comprises illustrations for operation of a lifting mechanism of a carriage guide shaft; FIG. 17 is an operation diagram of the side pressing roller and the pushing roller for the tray.

As shown in FIG. 7, if the CD conveyance section 8 serving as the guide member is made to slide straight in the Y direction, the section 8 is engaged with the lower casing 99. At that time, as shown in FIG. 8 and FIG. 9, positioning is made upon insertion of the fitting portions located on each end of the tray guide 82 along the guide rail 993 formed on both sides of the lower casing 99. The hook 84 is structured pivotally on each side of the tray guide 82, and is urged in one direction. If the CD conveyance section 8 is made to slide up to a prescribed position, the section hits so as not to slide more. Then, the hook 84 operates as a stopper of the guide rail 993, and the CD conveyance section 8 is locked so as not to return even in the sliding direction. A tray guide detection sensor 344 made of a mechanism is provided at the platen 34 for detecting a state that the tray guide 82 is attached, and if the tray guide 82 is attached to the recording apparatus body, an attachment can be detected when a part of the tray guide 82 pushes the tray guide detection sensor 344.

Next, as shown in FIG. 10 and FIG. 12, where the sliding cover 81 is moved in a direction of the recording apparatus body, the arm 85 projects toward the recording apparatus body in association with the sliding cover 81. The spur holder 43 on which the spur 42 is mounted is structured so as to be capable of sliding in up and down directions with respect to the platen 34 and is urged with a spring of a prescribed pressure. Accordingly, the spur holder 43 is lifted up in a prescribed amount where the arm 85 enters between the spur holder 43 and the platen 34 as described above. At that time, the arm 85 may smoothly enter between the platen 34 and the spur base 43, and thereby a space is formed for passing the tray 83 between the platen 34 and the spur holder 43. The arm 85 is positionally set to enter between the platen 34 and the spur holder 43, and has a play with the tray guide 82 in a state where it is contained in the tray guide 82.

In a state that the sliding cover 81 is not moved in a direction toward the recording apparatus body, an opening 821 (see FIG. 6) is closed, and the tray 83 cannot be entered. If the sliding cover 81 is moved in the direction toward the recording apparatus body, the sliding cover 81 is structured to move in an obliquely upward direction, so that the opening 821 appears at a space for the tray guide 82. With this state, the tray 83 filled with a CD is inserted in the opening 821 and can be set at a prescribed position (see FIG. 14). This is to prevent the tray sheet 831 (see FIG. 13) at the front end of the tray 83 and the spur 42 from being damaged upon interference between the tray 83 and the spur 42 when the tray 83 is inserted and the spur holder 43 is not yet lifted.

As shown in FIG. 11, if the sliding cover 81 is pulled out of the recording apparatus body, the arm 85 is disengaged from the spur holder 43 in association with the sliding cover 81, thereby lowering the spur holder 43 and the spur 44 to a prescribed position. At that time, if the tray 83 is being engaged, the tray 83 is sandwiched at the opening 821 at the sliding cover 81 and the tray guide 82, and therefore the sliding cover 81 cannot be pulled more. This structure prevents the CD from being damaged by lowering the spur 44 as the CD remains in the recording apparatus body. If the sliding cover 81 is pulled, the sliding cover 81 operates on the hook 84, thereby disengaging the hook 84 from the guide rail 993 of the lower casing 99, and thereby releasing the engagement of the CD conveyance section 8 from the recording apparatus body.

The tray 83 as a tray member, as shown in FIG. 13, includes on a resin plate about the thickness of 2 mm to 3 mm, a CD attachment portion 832, a manipulation portion 833 gripped by an operator for inserting and pulling out the tray 83, position detection marks 834*a*-834*c*, holes 835 for pulling out the CD, marks 836 for matching the inserting position, an escaping portion 837 for a side pressing roller, and a mark 838 for detecting media existence. The tray sheet 831 is attached to the tip of the tray 83 for ensuring engagement of the conveyance roller 36 and the pinch roller 37 with the tray 83.

The position detection marks 834*a*-834*c* are for detecting the position by the tray position detection sensor mounted on the carriage 50. This enables the sensor to accurately detect the position even when detecting a colored CD or a CD with a pre-printed surface in comparison with the method directly reading the edges of the CD's printing regions. The CD attachment portion 832 is in a concave shape for attaching the CD.

The tray sheet 831 is attached to the tip of the tray 83 for ensuring the engagement of the tray 83 by the conveyance roller 36 and the pinch roller 37, and the tray 83 itself has a tapered portion 830.

The tray sheet 831 is engaged with the conveyance roller 36 and the pinch roller 37 to produce the conveyance force, and the pinch roller 37 is lifted by the tapered portion 830 of the tip of the tray 83, thereby sandwiching the thick tray 83 with the conveyance roller 36 and the pinch roller 37, and thereby enabling the tray 83 to be conveyed. The position detection marks 834*a*-834*c* are formed between the pinch rollers 37. Consequently, the position detection marks 834*a*-834*c* avoid contact with the pinch roller 37, thus preventing scratches on the surface.

As shown in FIG. 17, a side pressing roller 824 is formed at the tray guide 82 to push the tray 83 to the reference 827 of the tray guide 82, and the tray 83 is positionally set by pushing the tray 83 to the reference 827 with a prescribed pressure with a roller spring. The side pressing roller 824 operates until that the operator sets the tray 83 to the prescribed position, and the side pressing roller 824 does not exert force against the tray 83 because the side pressing roller escaping portion 387 comes to the position at which the side pressing roller 324 of the tray 83 exerts force when the tray 83 is conveyed with the conveyance roller 36 and the pinch roller 37. Accordingly, excessive back tension or the like is not exerted on the tray 83, thereby preventing the conveyance accuracy of the tray 83 from lowering.

A pushing roller 811 is formed on each side at the sliding cover 81, and the conveyance force of the tray 83 is produced by pushing the tray 83 to the delivery roller 41 with the roller spring at a prescribed pressure. This conveyance force allows the tray 83 to be conveyed to the nipping portion between the conveyance roller 36 and the pinch roller 37 at a time of beginning the printing from the set position. The tray 83 can be conveyed to a prescribed position at which the operator takes out the tray when the printing ends. In this situation, the positions of the position detection marks 834 and the pressure roller 811 are structurally different, so as to avoid the position detection mark 834 from contacting the pressing roller 811 and prevent scratches on the surface.

The tray 83 is taken out of the tray guide 82 by pulling out the tray 83 conveyed to the prescribed position. By utilizing the CD taking out holes 835 located at two places, the operator can easily take out the outer peripheral edge of the CD.

Next, the operation of printing on the CD when the above structure is used is described. Where the CD conveyance section 8 is made to slide straight toward the recording apparatus body, the section 8 is attached to the lower casing 99. At that time the tray guide detection sensor 344 can detect that the tray guide 82 is attached to the recording apparatus body.

When the sliding cover 81 is moved in the recording apparatus body direction, the arm 85 projects in the recording apparatus body direction in association with the sliding cover 81. When the arm 85 enters between the spur holder 43 and the platen 34, the spur holder 43 is lifted up by the prescribed amount.

When the sliding cover 81 is moved in the recording apparatus body direction, the opening 821 appears in a space in the tray guide 82, because the sliding cover 81 is structured to move obliquely upward. In this state, as shown in FIG. 14, the tray 83 loaded with the CD is inserted through the opening 821 and can be set at a prescribed position.

The CD is attached to the CD attaching portion 832 of the tray 83. The operator holds the controlling portion 833, and inserts the tray 83 until the position detection marks 834 coincide with the tray set marks 826 of the tray guide 82.

Under this condition, if the recording signal is sent to the host device, the recording operation begins. First, as shown in FIG. 15, the conveyance roller 36, the delivery roller 40, and the delivery roller 41 are rotated reversely. Because the conveyance force of the tray 83 is produced by pushing the tray 83 to the delivery roller 40 and the delivery roller 41 with the prescribed pressure by means of the pushing roller 811 and the roller spring, the tray 83 is conveyed to the interior of the recording apparatus according to the reverse rotation of the delivery roller 40 and the delivery roller 41. The prescribed conveyance force is produced by engagement of the tray sheet 831 with the conveyance roller 36 and the pinch roller 37, and the pinch roller 37 is lifted up at the tapered portion 830 of the front end of the tray 83, thereby sandwiching the tray 83 between the conveyance roller 36 and the pinch roller 37.

Subsequently, the carriage 50 moves to the recording region from the home position to detect the tray 83. At that time, as shown in FIG. 16, the carriage lifting motor 58 drives to lift up the guide shaft 52, thereby forming an optimum gap with the tray 83.

The tray position detection sensor attached to the carriage 50 detects the position of the tray 83 (the position in the carriage's scanning direction and its perpendicular direction (conveyance direction)) and the existence of the CD.

When the series of initial operations as described above ends, the tray 83 is conveyed to a prescribed position at a rear side of the recording apparatus where the entire CD can be recorded. Then, recording begins corresponding to the image data sent from the host. Band irregularity or the like due to conveyance accuracy and droplet arrival accuracy can be reduced by recording in which images are formed by plural scanning lines, or so called multi-path recording of images.

After recording ends, the tray 83 is conveyed to the position (see FIG. 14) where the operator had set the tray 83 in the tray guide 82 before the recording as described above. The operator can then take out the tray 83 on which the recorded CD is mounted. The arm 85 is disengaged from the spur holder 43 upon pulling the sliding cover 81, and the hook 84 is disengaged from the lower casing 99, thereby disengaging the CD conveyance section 8 from the recording apparatus body, and enabling removal of the section 8.

[Relation Between the Conveyance Route of the CD and the Conveyance Route of the Sheet Material]

Referring to FIG. 18 to FIG. 21, a relation between the feeding section and the CD printing is described. FIG. 18 and FIG. 19 are perspective views showing a relation between the feeding section and the tray conveyance route; FIG. 20 and FIG. 21 are cross-sectional views showing a relation between the returning lever and the tray conveyance route. FIG. 20 depicts an ordinary CD printing state; FIG. 21 is an example where the returning lever is projecting in the tray conveyance route.

As described above, recording is effected by commonly using a single recording section formed of the conveyance section 3, the carriage section 5, and the delivery section 4, for recording of the sheet materials P as recording media having low rigidity by using the feeding section 2 and recording of CDs as recording media having high rigidity by not using the feeding section 2.

In this case, the apparatus rear side with respect to the conveyance roller 36 (or on the upstream side in the conveyance direction of the sheet material P) necessarily greatly differs. That is, a conveyance route extending substantially straight is needed for conveying the recording media having high rigidity when recording is to be effected on the CD, and when recording is to be effected on the sheet material P, the sheet material P is necessarily fed from the obliquely upper side as described above because the recording media having low rigidity need be pushed to the platen 34. There are many members projecting downwardly (rigid body conveyance route side) in the conveyance route for the sheet material P (hereinafter referred to as "sheet path"), such as the separation roller 241 constituting the separation section of the feeding section 2, and the returning lever 22. Those members of the feeding section 2 (such as the separation roller 241 and the returning lever 22) have a relation interfering with (or a relation overlapping with) the CD path serving as the rigid body conveyance route with respect to the vertical cross-sectional direction of the apparatus.

To solve this problem, the above interference may be solved if the feeding section 2 is isolated toward the rear upward side (or namely, upward on the upstream side in the conveyance direction of the sheet material). The sheet material P having a short length in the conveyance direction, however, may not be recorded; the recording speed may be lowered; and problems such as paper jamming or the like may easily occur because the sheet material is guided lengthwise. The height of the apparatus may become high, and the installation area of the apparatus may become larger. A separation method in which projections downward from the separation portion (or toward the CD path side) are in a smaller number may be adopted.

In this embodiment, to solve the above problems, a part of the feeding section 2 is overlapped with the rigid body conveyance route extending substantially straight but not overlapped in the width direction substantially perpendicular to the conveyance direction of the recording media. More specifically, as shown in FIG. 21, a part (the feeding roller 28, the separation roller 241) of the feeding portion 2 overlapping with the rigid body conveyance route in the vertical cross-sectional direction is arranged closely to one end in the width direction as shown in FIG. 18 and FIG. 19 for feeding the sheet material P along one end (reference side) in the width direction as a reference, and the rigid body conveyance route is a route in which the CD (or the tray 83 mounting the CD) is conveyed along the other end in the width direction (non-reference side) as a reference and is structured not to overlap with the part of the feeding section 2 in the width direction. With this structure, the recording apparatus can be provided with a low cost and compact structure and without impaired performance.

The returning lever 22 described above is unitedly formed with tongs at two portions on both sides of the separation section in this embodiment. Thus, where the returning member is used for the separation portion as a part of the feeding section 2, oblique feeding or double feeding is prevented, and the sheet material P can be returned stably.

It is to be noted that the number of tongs formed unitedly with the returning lever 22 is not limited to this, and a greater number can be used. For example, to stably return the sheet material having a large width and the sheet material having a small width, the returning lever 22 can be formed unitedly with tongs on the non-reference side as shown in FIG. 18.

However, in this case, as is apparent from FIG. 18, one returning lever 22 exists in forming united tongs even at a position overlapping with the CD path in the width direction.

This returning lever 22 is escapable from the CD path through which the tray 83 mounting the CD is conveyed, and as shown in FIG. 20, it is structured to allow recording on the recording medium having high rigidity, such as a CD, by escaping from the CD path as shown in FIG. 20. This increases degrees of freedom and can provide a feeding section having good performance.

The tongs of the returning lever are pivotally moved with pivotal movement of the lever, but each tong is coupled at a position (escaping position) not entering the CD path as shown in FIG. 20 where the feeding section 2 is at an angle of the waiting position. Accordingly, a connecting portion of the returning lever 22 projects in the CD path during the series of feeding operations, but there is no concern that the CD cannot pass during feeding from the feeding section. That is, the position at which the returning lever 22 escapes from the CD path as shown in FIG. 20 becomes the waiting position at the feeding section 2. This provides an apparatus in which the feeding section 2 is not operated when the recording medium having high rigidity, such as CD, is recorded in the ordinary state. This also helps in not requiring the separation portion to move rear upwardly (or upward on the upstream side in the sheet conveyance direction). That is, this structure prevents the apparatus height from becoming higher and the installation area from becoming larger.

FIG. 21 depicts an example in which the returning lever 22 is projecting in the rigid body conveyance route (CD path). The returning lever 22 moves pivotally in the counterclockwise direction in FIG. 21 during the feeding operation, thereby opening the conveyance route of the sheet material (the front end of the returning lever is hidden by the base 20). Under this condition, the reinforcement portion (connecting portion described above) of the returning lever 22 disturbs the conveyance of the tray 83. It is to be noted that in FIG. 21, the returning lever 22 and the tray 83 are illustrated for ease of understanding.

With the above structure, because the feeding section 2 during the CD printing is necessarily at the waiting position, the position (phase) of the feeding portion 2 is detected by the ASF sensor as a first detecting means, and when the feeding section is not in the waiting state, or when the returning lever is not escaped from the CD path, an error is issued when the CD printing is executed. This can avoid wasteful recording.

At that time, without issuing any error, it is better to operate the feeding section 22 to be at the waiting position. That is, the apparatus is structured such that where the returning lever 22 is not escaped from the CD path, recording is effected after the returning lever 22 is made to escape from the CD path. This can help the apparatus to not produce any error.

When the sheet materials P are stacked on the feeding section 2, the sheet materials P may presumably be conveyed. In such a situation, because the recording section is used commonly as described above, the sheet material P and the tray 83 may interfere with each other. When the PE sensor 32 as the second detecting means detects the sheet material existence, an error is issued, and when no sheet material is detected, an operation is made in which the CD printing is performed normally after the feeding section 2 is at the waiting position (returning lever escaping state) as described above. If the feeding section 2 is located initially at the waiting position, an error is issued in the same way when the PE sensor 32 detects the existence of the sheet material. This prevents jamming of the recording medium, and prevents performance of a normal operation when unnecessary.

It is desirable to operate the apparatus so that the feeding section 2 is initialized upon powering on, so that the tray guide detection sensor 344 as the third detecting means detects the tray guide 82 when the returning lever 22 as a part of the feeding section 2 is made to escape from the CD path, and so that an error is issued when the PE sensor as the second detecting means detects the sheet material in the same way. With this structure, jamming of the recording medium can be prevented in advance.

Conversely, if feeding is made from the feeding section, it is desirable to issue an error when the tray guide detection sensor 344 detects the tray guide 82. This structure prevents the recording medium from being predisposed to paper jamming.

This is presumably because of the existence of the tray 83, but it is desirable to issue an error where the tray guide sensor 344 detects the tray guide. This structure avoids predisposition to paper jamming.

This is because the tray 83 exists, but it is desirable to issue an error because the tray guide 82 itself may block the reference side of the delivery portion 4 (since the guide exists in the width direction of the tray 83). That is, it is desirable to issue an error when the fourth detecting means detects the tray 83 or the CD when feeding is made from the feeding section. This structure prevents the recording medium from being predisposed to paper jamming.

It is to be noted that the fourth detecting means can be the tray detection sensor, but a tray existence detecting sensor using a photo-interrupter of the same type as the PE sensor may be provided as a separate member.

Accordingly, the same operation can be made with the output in a structure having the tray position detection sensor serving as the fourth detecting means for detecting the tray 83, but it is preferable to use the tray guide detection sensor 344 as the third detecting means detecting that the tray guide 82 is attached.

[Other Embodiments]

Although in the above embodiment a part of the feeding section overlapping with the conveyance route in the vertical cross-sectional direction of the apparatus is at least a part of the returning lever for returning the sheet material on the upstream side in the conveyance direction, this invention is not limited to this. For example, even where a part of the feeding section overlapping with the conveyance route in the vertical cross-sectional direction of the apparatus is a separation roller or separation pad having a large frictional coefficient for stopping the sheet material, substantially the same advantages can be obtained in application of the invention, and the separation performance can be made higher in comparison with the returning lever. Even where a part of the separation roller or the separation pad is overlapping with the rigid body conveyance route in the width direction, substantially the same advantages as in the embodiment described above can be obtained with a structure in which the separation roller and the separation pad are movable to the position escaping from the rigid body conveyance route (or waiting position).

Although in the embodiment described above, an example using an inkjet recording method as a recording means is exemplified, the recording method is not limited to this, and can be another recording method such as electrophotographic recording method.

What is claimed is:

1. A recording apparatus for recording with recording means, comprising:

a feeding section for separately feeding recording paper sheet by sheet; and a conveyance route extending substantially straight for conveying a recording medium having a high rigidity, wherein a part of the feeding section is overlapped with the conveyance route in a vertical cross-sectional direction but is not overlapped in a direction intersecting a conveyance direction of the recording medium.

2. The recording apparatus according to claim 1, wherein the part of the feeding section that is overlapped with the conveyance route in the vertical cross-sectional direction is a separation portion for separating sheets of the recording paper.

3. The recording apparatus according to claim 2, wherein the part of the feeding section that is overlapped with the conveyance route in the vertical cross-sectional direction is a separation roller or separation pad for separating sheets of the recording paper.

4. The recording apparatus according to claim 2, wherein the recording paper is conveyed such that one end in a widthwise direction of the recording paper serves as a reference surface, wherein the separation portion is arranged closely to the reference surface, and wherein the conveyance route is disposed at a position farther than the separation portion with respect to the reference surface.

5. The recording apparatus according to claim 1, wherein the part of the feeding section that is overlapped with the conveyance route in the vertical cross-sectional direction is a returning member for returning the recording paper toward the upstream side in the conveyance direction.

6. The recording apparatus according to claim 1, wherein the conveyance direction of the recording paper and the recording medium having the high rigidity at a position facing the recording means is substantially horizontal, and wherein the recording paper is conveyed from the feeding section with an angle of 10 to 15 degrees with respect to the horizontal direction to the position facing the recording means.

7. The recording apparatus according to claim 1, wherein the recording medium having the high rigidity is conveyed while mounted on a tray member.

8. The recording apparatus according to claim 7, wherein the tray member is inserted from a side of delivery of the recording paper toward the recording means.

9. The recording apparatus according to claim 8, wherein a guide member for guiding the tray member is detachably attached to a recording apparatus body.

10. The recording apparatus according to claim 1, wherein a part of the feeding section can enter into and escape from the conveyance route, and wherein the feeding section conveys the recording medium having the high rigidity when the part of the feeding section is escaped from the conveyance route.

11. The recording apparatus according to claim 10, wherein the position of the part of the feeding section escaped from the conveyance route is a waiting position of the feeding section.

12. The recording apparatus according to claim 10, wherein the part of the feeding section is a returning member for returning the recording paper on the upstream side of the conveyance route.

13. The recording apparatus according to claim 10, further comprising detecting means for detecting a phase of the feeding section to detect an error when the part of the feeding section is not escaped from the conveyance route when the recording medium having the high rigidity is conveyed.

14. The recording apparatus according to claim 10, further comprising detecting means for detecting a phase of the feeding section, wherein the recording medium having the high rigidity is conveyed after the part of the feeding section escapes from the conveyance route.

15. The recording apparatus according to claim 10, further comprising first detecting means for detecting a phase of the feeding section, and second detecting means for detecting the recording paper fed from the feeding section, wherein the part of the feeding section is made to escape from the conveyance route, and wherein the recording medium having the high rigidity is conveyed when the second detecting means does not detect the recording paper.

16. The recording apparatus according to claim 9, further comprising detecting means for detecting attachment of the guide member to the recording apparatus body, wherein an error is detected when the detecting means detects the attachment of the guide member before the recording paper is fed from the feeding section.

17. The recording apparatus according to claim 7, further comprising detecting means for detecting the tray member, wherein an error is detected when the detecting means detects the tray member while the recording paper is fed from the feeding section.

18. The recording apparatus according to claim 1, wherein the recording means discharges ink to effect recording.

* * * * *

UNITED STATES PATENT AND TRADEMARK OFFICE

CERTIFICATE OF CORRECTION

PATENT NO. : 6,871,949 B2
DATED : March 29, 2005
INVENTOR(S) : Nakano et al.

It is certified that error appears in the above-identified patent and that said Letters Patent is hereby corrected as shown below:

Column 9,
Lines 43 and 51, “sunctioned” should read -- suctioned --.
Line 48, “sunctioned.” should read -- suctioned. --.

Column 10,
Line 26, “storaged” should read -- storage --.

Signed and Sealed this

Twentieth Day of December, 2005

JON W. DUDAS
*Director of the United States Patent and Trademark Office*